US009417555B2

(12) United States Patent
Mitsunobu

(10) Patent No.: US 9,417,555 B2
(45) Date of Patent: Aug. 16, 2016

(54) IMAGE FORMING APPARATUS

(71) Applicant: Oki Data Corporation, Tokyo (JP)

(72) Inventor: Hidetaka Mitsunobu, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/831,117

(22) Filed: Aug. 20, 2015

(65) Prior Publication Data

US 2016/0085175 A1 Mar. 24, 2016

(30) Foreign Application Priority Data

Sep. 22, 2014 (JP) ..... 2014-192660

(51) Int. Cl.
*G03G 15/08* (2006.01)
*G03G 15/06* (2006.01)

(52) U.S. Cl.
CPC ..... *G03G 15/065* (2013.01)

(58) Field of Classification Search
CPC ..... G03G 15/065
USPC ..... 399/285
See application file for complete search history.

(56) References Cited

U.S. PATENT DOCUMENTS 6,032,012 A * 2/2000 Hirono ..... G03G 15/0815 399/103
6,671,485 B2 * 12/2003 Hirano ..... G03G 15/0812 399/284
2004/0136742 A1 7/2004 Saito et al.
2004/0136758 A1 * 7/2004 Kera ..... G03G 15/0131 399/299
2004/0146312 A1 * 7/2004 Saito ..... G03G 15/065 399/55
2007/0053707 A1 * 3/2007 Ream ..... G03G 15/0812 399/55
2009/0080921 A1 * 3/2009 Shimizu ..... G03G 15/0812 399/55
2010/0054780 A1 3/2010 Kitamura et al.
2010/0239328 A1 * 9/2010 Yamada ..... G03G 9/09708 399/285
2014/0037311 A1 * 2/2014 Mitsunobu ..... G03G 15/0121 399/46
2014/0255053 A1 9/2014 Ohshika
2015/0093129 A1 * 4/2015 Mitsunobu ..... G03G 15/50 399/40

FOREIGN PATENT DOCUMENTS

EP 0404561 A2 12/1990
JP 2014-032280 A 2/2014

* cited by examiner

*Primary Examiner* — David Gray
*Assistant Examiner* — Tyler Hardman
(74) *Attorney, Agent, or Firm* — Rabin & Berdo, P.C.

(57) ABSTRACT

An image forming apparatus includes a plurality of image forming units. A first image forming unit includes a first image carrier, a first developer carrier that is applied with a first developing voltage, and a first layer-forming member that is applied with a first layer-forming voltage having the same polarity as polarity of the first developing voltage. The second image forming unit includes a second image carrier, a second developer carrier that is applied with a second developing voltage, and a second layer-forming member that is applied with a second layer-forming voltage having the same polarity as polarity of the second developing voltage. An absolute value of the first layer-forming voltage is smaller than an absolute value of the first developing voltage. An absolute value of the second layer-forming voltage is greater than an absolute value of the second developing voltage.

28 Claims, 13 Drawing Sheets

IMAGE FORMING APPARATUS

BACKGROUND OF THE INVENTION

1. Field of the Invention

The present invention relates to an electrophotographic image forming apparatus including a plurality of image forming units.

2. Description of the Related Art

In general, when a color image is printed on a recording medium such as paper, an electrophotographic color image forming apparatus using a plurality of developers (for example, toners) of different colors is used. In recent years, there are cases in which a white image is printed on colored paper (for example, black paper), a transparent film used for an overhead projector (OHP), and the like. In such cases, image forming apparatuses including an image forming unit which uses a white toner are utilized. See Patent reference 1, Japanese patent application publication No. 2014-32280, for example.

However, in a case where an image is formed by an image forming apparatus using a toner (for example, white toner) having characteristics different from those of color toners (for example, black color toner, cyan color toner, magenta color toner, and yellow color toner) generally used in electrophotographic color image forming apparatuses, "fogging toner" increases and therefore a phenomenon called "fogging" tends to occur, thereby lowering the image quality. Furthermore, "fogging toner" is a low-charge-amount toner (i.e., a toner with a small absolute value of charge amount) that could cause fogging and a toner charged to a polarity opposite to a polarity to which the toner should be normally charged. "Fogging" is a phenomenon that the toner having a lower charge amount than the normally charged toner or the toner charged to a polarity opposite to a polarity to which the toner should be normally charged adheres to a background of the image (that is, a non-image area).

SUMMARY OF THE INVENTION

It is therefore an object of the present invention to provide an image forming apparatus that improves image quality.

An image forming apparatus according to an aspect of the present invention includes a plurality of image forming units. The plurality of image forming units include a first image forming unit that uses a first developer having first charging characteristics and a second image forming unit that uses a second developer having second charging characteristics differing from the first charging characteristics. The first image forming unit includes a first image carrier, a first developer carrier that is applied with a first developing voltage and develops a latent image on the first image carrier with the first developer, and a first layer-forming member that is applied with a first layer-forming voltage having the same polarity as polarity of the first developing voltage and is disposed to face the first developer carrier. The second image forming unit includes a second image carrier, a second developer carrier that is applied with a second developing voltage and develops a latent image on the second image carrier with the second developer, and a second layer-forming member that is applied with a second layer-forming voltage having the same polarity as polarity of the second developing voltage and is disposed to face the second developer carrier. An absolute value of the first layer-forming voltage is smaller than an absolute value of the first developing voltage. An absolute value of the second layer-forming voltage is greater than an absolute value of the second developing voltage.

An image forming apparatus according to another aspect of the present invention includes a plurality of image forming units. The plurality of image forming units include a first image forming unit that uses a first developer having first charging characteristics and a second image forming unit that uses a second developer having second charging characteristics differing from the first charging characteristics. The first image forming unit includes a first image carrier a first developer carrier that is applied with a first developing voltage and develops a latent image on the first image carrier with the first developer and a first layer-forming member that is applied with a first layer-forming voltage having the same polarity as polarity of the first developing voltage and is disposed to face the first developer carrier. The second image forming unit includes a second image carrier a second developer carrier that is applied with a second developing voltage and develops a latent image on the second image carrier with the second developer and a second layer-forming member that is applied with a second layer-forming voltage having the same polarity as polarity of the second developing voltage and is disposed to face the second developer carrier. In a case where $|Vbb|$ is an absolute value of the first layer-forming voltage, $|Vdb|$ is an absolute value of the first developing voltage, $|Vbw|$ is an absolute value of the second layer-forming voltage, and $|Vdw|$ is an absolute value of the second developing voltage, a condition $(|Vbb|-|Vdb|)<(|Vbw|-|Vdw|)$ is satisfied.

According to the present invention, the image forming apparatus improves image quality.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1:
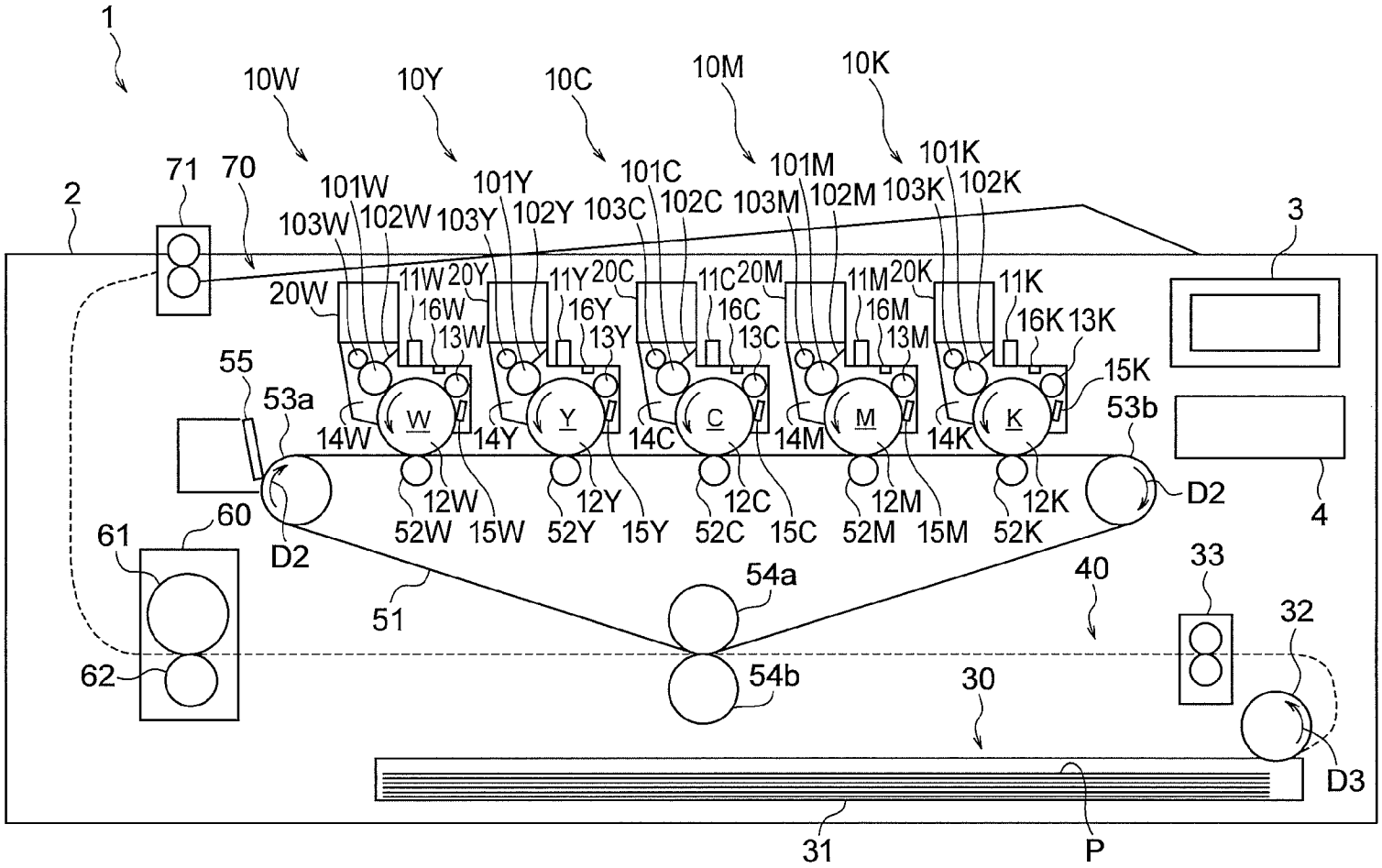
FIG. 1 is a longitudinal sectional view schematically showing a configuration of an image forming apparatus according to a first embodiment of the present invention.
Figure 2:
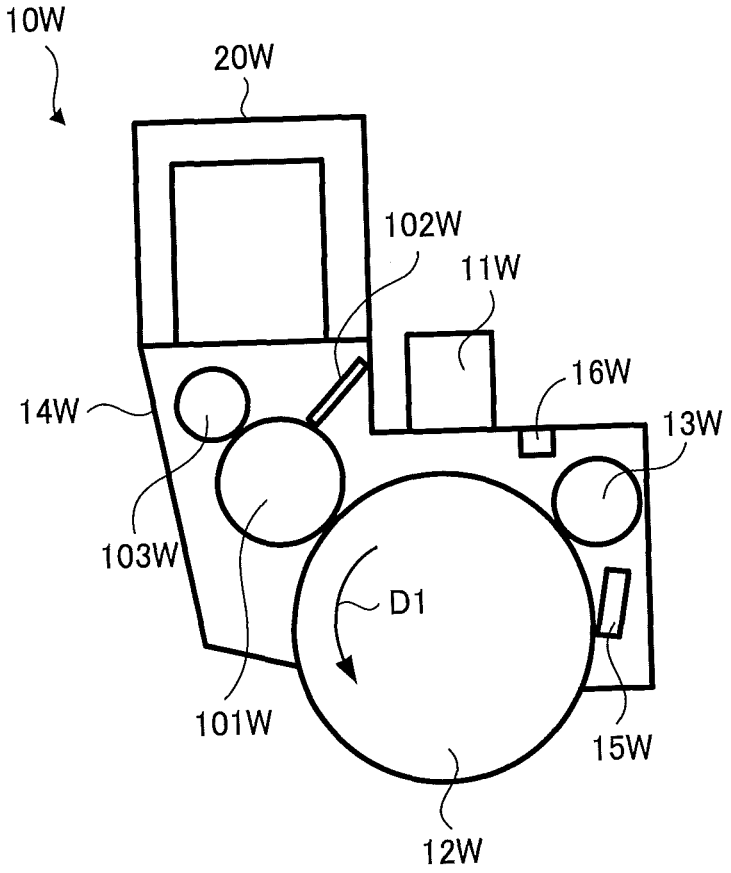
FIG. 2 is an enlarged sectional view schematically showing a configuration of one image forming unit of a plurality of image forming units in the first embodiment.

FIG. 1 is a longitudinal sectional view schematically showing a configuration of an image forming apparatus 1 according to a first embodiment of the present invention. The image forming apparatus 1 is an electrophotographic color printer, for example. FIG. 2 is an enlarged sectional view schematically showing a configuration of an image forming unit 10W in the first embodiment. Since the respective image forming units 10W, 10Y, 10C, 10M, and 10K have the same internal structure with each other, FIG. 2 shows the image forming unit 10W as a representative example.

As shown in FIG. 1, the image forming apparatus 1 includes a housing 2, a display unit 3 which displays a status of the image forming apparatus 1, and a control unit 4 including various kinds of controllers which control operation of the image forming apparatus 1.

The image forming apparatus 1 further includes image forming units 10W, 10Y, 10C, 10M, and 10K as image forming sections for forming developer (toner) images of respective colors by electrophotography, toner cartridges (toner containers) 20W, 20Y, 20C, 20M, and 20K as developer cartridges for supplying the image forming units 10W, 10Y, 10C, 10M, and 10K with toners as developers of the respective colors, a paper feeder 30 as a medium supply section for supplying recording medium P such as paper, and a medium conveying section 40 for conveying the recording medium P. The image forming apparatus 1 further includes an endless intermediate transfer belt 51 onto which toner images formed by the image forming units 10W, 10Y, 10C, 10M, and 10K are transferred, first transfer rollers 52W, 52Y, 52C, 52M, and 52K for transferring toner images onto the intermediate transfer belt 51, drive rollers 53*a* and 53*b* for driving the intermediate transfer belt 51, and second transfer rollers 54*a* and 54*b* for transferring the toner images on the intermediate transfer belt 51 onto the recording medium P. The image forming apparatus 1 further includes a cleaning blade 55 for cleaning a transfer residual toner off the intermediate transfer belt 51, a fixing unit 60 as a fixing section for fixing transferred toner images onto the recording medium P, and a discharge roller unit 71 for discharging the recording medium P which has passed the fixing unit 60 onto a discharge cassette 70 as a stacker. The fixing unit 60 includes a heat roller 61 which is provided with a heating element such as a halogen lamp in its inside and heats the recording medium P and a pressure roller 62 which presses the toner image on the recording medium P.

The image forming units 10W, 10Y, 10C, 10M, and 10K are arranged in that order from an upstream side to a downstream side in a direction of rotation of the intermediate transfer belt 51. The image forming units 10W, 10Y, 10C, 10M, and 10K include identification memories 16W, 16Y, 16C, 16M, and 16K for identifying types (for example, toner colors) of the image forming units respectively. When any of the image forming units is mounted in the image forming apparatus 1 (for example, apparatus main body), the image forming apparatus 1 recognizes the mounting of the image forming unit and the type of the mounted image forming unit on the basis of information (for example, information for identifying the type of the image forming unit) stored in the identification memories 16W, 16Y, 16C, 16M, or 16K (that is, the identification memory of the mounted image forming unit) and executes appropriate control in accordance with the type of the image forming unit. The identification memories 16W, 16Y, 16C, 16M, and 16K are semiconductor element chips utilizing the radio frequency identifier (RFID) technology, for example.

Five image forming units 10W, 10Y, 10C, 10M, and 10K and five toner cartridges 20W, 20Y, 20C, 20M, and 20K are shown in FIG. 1, but the number of the image forming units and the number of the toner cartridges included in the image forming apparatus 1 may be two to four or may also be six or more. Furthermore, the present invention can be applied to other electronic equipment such as a copier, a facsimile apparatus, and a multifunction peripheral (MFP) so long as it is a device adopting an electrophotography method.

As shown in FIG. 1, the paper feeder 30 includes a paper cassette 31 as a medium cassette containing media such as paper, a paper feed roller 32 which sends out each sheet of the recording media P stacked in the paper cassette 31, and a pair of conveying rollers 33 which conveys the recording medium P sent from the paper cassette 31. Furthermore, a configuration of the paper feeder 30 is not limited to the example shown in FIG. 1, and a different configuration may be adopted.

The image forming units 10W, 10Y, 10C, 10M, and 10K form a white (W) color toner image, a yellow (Y) color toner image, a magenta (M) color toner image, a cyan (C) color toner image, and a black (K) color toner image by electrophotography respectively. The toner cartridges 20W, 20Y, 20C, 20M, and 20K contain a white color toner, a yellow color toner, a magenta color toner, a cyan color toner, and a black color toner (hereafter also referred to as a white toner, a yellow toner, a magenta toner, a cyan toner, and a black toner respectively) respectively. The toner cartridges 20W, 20Y, 20C, 20M, and 20K supply corresponding developing devices 14W, 14Y, 14C, 14M, and 14K with the toners respectively when the corresponding developing devices 14W, 14Y, 14C, 14M, and 14K are supplied with the toners. As the toners of the image forming unit 10W and the toner cartridge 20W, a metallic color toner may be used instead of the white toner. In the present application, the white toner and the metallic color toner are also referred to as a spot color toner.

In the image forming apparatus 1, the white toner and the metallic color toner can be used alternatively by exchanging each other. When the color of the toner used as the spot color toner is switched, the color of the toner to be used as the spot color toner can be switched between white toner and metallic color toner by making an exchange between the image forming unit and toner cartridge corresponding to the white toner and the image forming unit and toner cartridge corresponding to the metallic color toner. Furthermore, in the first embodiment, the example in which the white toner, yellow toner, cyan toner, magenta toner, and black toner are used has been described, but toners of arbitrary colors may be used as the toners other than the spot color toner.

Except for the difference of colors of the toners, the image forming units 10W, 10Y, 10C, 10M, and 10K have basically the same elements with each other. Furthermore, except for the difference of colors of the toners, the toner cartridges 20W, 20Y, 20C, 20M, and 20K have basically the same structure with each other.

The toners of the respective colors of the white toner, the yellow toner, the cyan toner, the magenta toner, and the black toner contain a polyester resin, a colorant, a charge control agent, a release agent, and so on. Moreover, an external additive (for example, hydrophobic silica) may be added to the toners of the respective colors. It is preferable that the toners of the respective colors used in the first embodiment have a pulverized grain shape obtained by the pulverization method and an average particle diameter of about 8 μm, for example. The toners of the respective colors, however, may also be toners produced by other manufacturing methods such as the polymerization method. Each of the yellow toner, cyan toner, magenta toner, and black toner contains an organic pigment as the colorant. It is preferable that the pigment used as the colorant be a comparatively transparent pigment, and for example, it is preferable that pigment yellow, pigment cyan, pigment magenta, and carbon black be used.

In the present application, the white toner is a white color toner, and includes either a toner to which metal-containing colorant is added or a toner containing a metal oxide. As the metal oxide, any of a titanium oxide, an aluminum oxide, a barium sulfate, and a zinc oxide can be used. The metal-containing colorant is an opaque colorant containing a metallic pigment (for example, a titanium dioxide).

In the present application, the "metallic color toner" is a color toner having any one or more of golden color, silver color, and bronze color, and the toner containing any one or more of aluminum, silver, and a fluorescent pigment in order to have metallic luster. The metallic color toner may contain a yellowish orange fluorescent pigment to have a golden color and may contain a red-orange fluorescent pigment to have a bronze color, for example.

White paper, non-white, colored paper, and transfer paper for transferring an image onto a medium such as a T-shirt can be used as the recording medium P. The colored paper is plain paper having a color other than white, such as black color paper, blue color paper, and red color paper. In a case where transfer paper is used as the recording medium P, the image forming apparatus 1 fixes a toner image onto the transfer paper, and the toner image fixed on the transfer paper is transferred onto a T-shirt or the like by the heat of an iron or the like.

As shown in FIG. 1, the image forming units 10W, 10Y, 10C, 10M, and 10K include LED heads 11W, 11Y, 11C, 11M, and 11K as exposure devices, photosensitive drums 12W, 12Y, 12C, 12M, and 12K as image carriers which are rotatably supported, charging rollers 13W, 13Y, 13C, 13M, and 13K as charging members for uniformly charging the surface of the photosensitive drums 12W, 12Y, 12C, 12M, and 12K, respectively. The image forming units 10W, 10Y, 10C, 10M, and 10K further include developing devices 14W, 14Y, 14C, 14M, and 14K which form a toner image corresponding to the electrostatic latent image by supplying toner to the surface of the photosensitive drums 12W, 12Y, 12C, 12M, and 12K after forming an electrostatic latent image on the surface of the photosensitive drums 12W, 12Y, 12C, 12M, and 12K by exposure with the LED heads 11W, 11Y, 11C, 11M, and 11K, and cleaning blades 15W, 15Y, 15C, 15M, and 15K which clean the surface of the photosensitive drums 12W, 12Y, 12C, 12M, and 12K, respectively.

The LED heads 11W, 11Y, 11C, 11M, and 11K, for example, includes an LED array in which a plurality of light-emitting diode (LED) elements are arranged in a direction of respective axes of the photosensitive drums 12W, 12Y, 12C, 12M, and 12K, respectively. The LED heads 11W, 11Y, 11C, 11M, and 11K receive drive signals based on image data of each color and irradiate the photosensitive drums 12W, 12Y, 12C, 12M, and 12K with exposure light based on the received drive signals, respectively.

As shown in FIGS. 1 and 2, the developing devices 14W, 14Y, 14C, 14M, and 14K include a toner storage member which forms a developer storage space for storing the toner, developing rollers 101W, 101Y, 101C, 101M, and 101K which supply the toner onto the surfaces of the photosensitive drums 12W, 12Y, 12C, 12M, and 12K, layer-forming blades 102W, 102Y, 102C, 102M, and 102K as layer-forming members for regulating thicknesses of toner layers carried by the developing rollers 101W, 101Y, 101C, 101M, and 101K, and supply rollers 103W, 103Y, 103C, 103M, and 103K which supply the toners stored in the toner storage members to the developing rollers 101W, 101Y, 101C, 101M, and 101K, respectively. The configurations of the image forming units 10W, 10Y, 10C, 10M, and 10K and the developing devices 14W, 14Y, 14C, 14M, and 14K are not limited to the examples given above, and other configurations may be adopted.

Each of the developing rollers 101W, 101Y, 101C, 101M, and 101K includes a metal shaft and an elastic body provided around the metal shaft, for example. Each elastic body of the developing rollers 101W, 101Y, 101C, 101M, and 101K are preferable to use semi-conducting urethane rubber with a rubber hardness of 70° (Asker C hardness), for example. Each of the supply rollers 103W, 103Y, 103C, 103M, and 103K includes a metal shaft and a foam body provided around the metal shaft, for example. Each foam body of the supply rollers 103W, 103Y, 103C, 103M, and 103K are preferable to use a silicone foam body that is formed so as to have a hardness (Asker F hardness) of 50°, for example.

The photosensitive drums 12W, 12Y, 12C, 12M, and 12K include a cylindrically-formed conductive supporting body and a photosensitive layer part formed by applying a photosensitive layer on the conductive supporting body. The photosensitive layer part is a laminated structure having a blocking layer, a charge-generating layer, and a charge transport layer on that order from the surface of the conductive supporting body. In the first embodiment, the photosensitive layer is coated on the conductive supporting body so as to include a charge transport layer of about 18 v, for example. Thickness of the photosensitive layer was measured with eddy-current coating thickness tester LH-200J of Kett Electric Laboratory.

Figure 3:
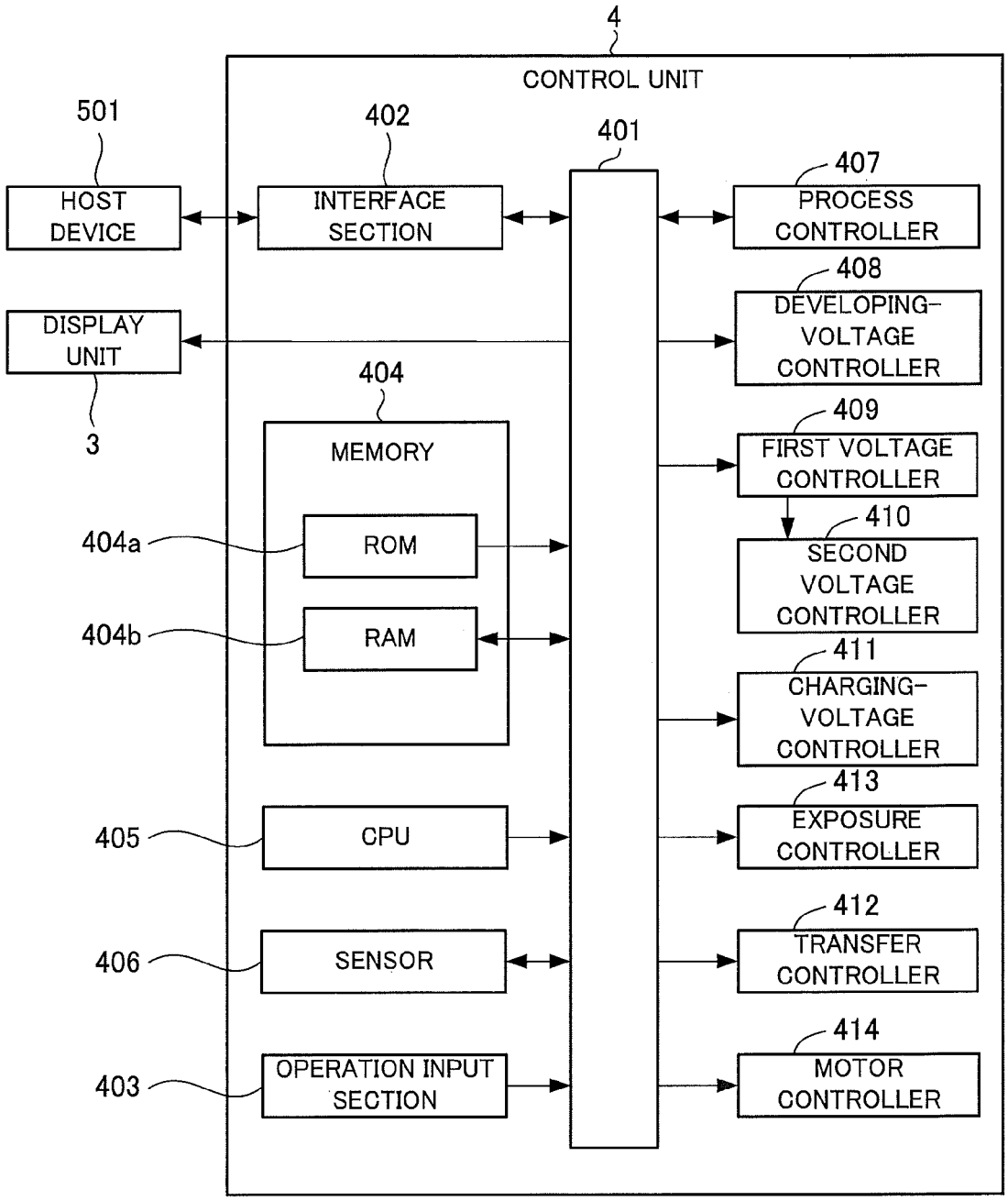
FIG. 3 is a block diagram showing a control system of the image forming apparatus according to the first embodiment.

FIG. 3 is a block diagram showing a control system of the image forming apparatus 1 according to the first embodiment. The image forming apparatus 1 is controlled mainly by the control unit 4. The control unit 4 includes a print controller 401 which receives a print instruction from a host device 501 such as a computer and sends an instruction to start image forming operation to each controller.

The print controller 401 sends information to the display unit 3 which displays the status of the image forming apparatus 1, such as whether the image forming operation is or is not in progress. An interface section 402 which receives image data from the host device 501 as an information input means and an operation input section 403 are connected to the print controller 401.

A memory 404 includes a read-only memory (ROM) 404*a* which stores information indicating print operation procedures and calculation formulae for performing various correction processing and a main memory (RAM: random access memory) 404*b*, and the ROM 404*a* and RAM 404*b* are connected to the print controller 401. Further, a central processing unit (CPU) 405, a sensor 406 which detects the recording medium P, temperature, and humidity, and a process controller 407 which performs voltage control for the rollers are connected to the print controller 401.

The developing rollers 101W, 101Y, 101C, 101M, and 101K are controlled by a developing-voltage controller 408. The supply rollers 103W, 103Y, 103C, 103M, and 103K and the layer-forming blade 102W are controlled by a first voltage controller 409. The layer-forming blades 102W, 102Y, 102C, and 102M are disposed to face the developing rollers 101W, 101Y, 101C, and 101M respectively. The layer-forming blade 102K is disposed to face the developing roller 101K, and is controlled by a second voltage controller 410. In the image forming unit 10W, the layer-forming blade 102W and the supply roller 103W are hard-wired connected to each other with a wiring.

The first voltage controller 409 and the second voltage controller 410 are connected to each other through a Zener diode and so on, for example. The first embodiment is configured so that an output voltage of the second voltage controller 410 is greater than that of the first voltage controller 409 by 150 V, for example.

The charging rollers 13W, 13Y, 13C, 13M, and 13K are controlled by a charging-voltage controller 411. The first transfer rollers 52W, 52Y, 52C, 52M, and 52K are controlled by a transfer controller 412. The LED heads 11W, 11Y, 11C, 11M, and 11K are controlled by an exposure controller 413.

A motor controller 414 controls motors connected to the photosensitive drums 12W, 12Y, 12C, 12M, and 12K, thereby rotating the photosensitive drums 12W, 12Y, 12C, 12M, and 12K in a direction of arrow D1. Each of the photosensitive drums 12W, 12Y, 12C, 12M, and 12K, developing rollers 101W, 101Y, 101C, 101M, and 101K, and supply rollers 103W, 103Y, 103C, 103M, and 103K has a gear disposed right beside, and the developing rollers 101W, 101Y, 101C, 101M, and 101K and the supply rollers 103W, 103Y, 103C, 103M, and 103K are engaged with gears of the corresponding photosensitive drums 12W, 12Y, 12C, 12M, and 12K. Therefore, each of the developing rollers 101W, 101Y, 101C, 101M, and 101K and the supply rollers 103W, 103Y, 103C, 103M, and 103K is rotationally driven by the rotary driving of the photosensitive drums 12W, 12Y, 12C, 12M, and 12K.

Operation of Image Forming Apparatus 1

When the host device 501 sends image data through the interface section 402 to the print controller 401, the print controller 401 sends instructions for executing image forming operation by the image forming apparatus 1, to the corresponding controllers. The motor controller 414 drives the motors connected to the photosensitive drums 12W, 12Y, 12C, 12M, and 12K to rotate the photosensitive drums 12W, 12Y, 12C, 12M, and 12K in the direction of arrow D1. As the photosensitive drums 12W, 12Y, 12C, 12M, and 12K rotate, the developing rollers 101W, 101Y, 101C, 101M, and 101K and supply rollers 103W, 103Y, 103C, 103M, and 103K connected to the photosensitive drums 12W, 12Y, 12C, 12M, and 12K rotate. Since the charging rollers 13W, 13Y, 13C, 13M, and 13K are in contact with the photosensitive drums 12W, 12Y, 12C, 12M, and 12K respectively, when the photosensitive drums 12W, 12Y, 12C, 12M, and 12K rotate, the charging rollers 13W, 13Y, 13C, 13M, and 13K are rotated by following the rotation of the photosensitive drums 12W, 12Y, 12C, 12M, and 12K.

The charging rollers 13W, 13Y, 13C, 13M, and 13K electrically charge the surfaces of the photosensitive drums 12W, 12Y, 12C, 12M, and 12K respectively. The LED heads 11W, 11Y, 11C, 11M, and 11K form electrostatic latent images based on the image data on the electrically charged surfaces of the photosensitive drums 12W, 12Y, 12C, 12M, and 12K respectively. The supply rollers 103W, 103Y, 103C, 103M, and 103K hold toners while rotating and supply the toners to the developing rollers 101W, 101Y, 101C, 101M, and 101K respectively. When the toners supplied onto the developing rollers 101W, 101Y, 101C, 101M, and 101K from the supply rollers 103W, 103Y, 103C, 103M, and 103K pass the layer-forming blades 102W, 102Y, 102C, 102M, and 102K, the thickness of the toner layers on the developing rollers 101W, 101Y, 101C, 101M, and 101K are regulated to a uniform thickness by shearing force of the layer-forming blades 102W, 102Y, 102C, 102M, and 102K.

By rotation of the developing rollers 101W, 101Y, 101C, 101M, and 101K, toners carried by the developing rollers 101W, 101Y, 101C, 101M, and 101K adhere to the photosensitive drums 12W, 12Y, 12C, 12M, and 12K. By adhesion of the toners to the photosensitive drums 12W, 12Y, 12C, 12M, and 12K on which the electrostatic latent images are formed, the toner images are formed on the surface of the photosensitive drums 12W, 12Y, 12C, 12M, and 12K. In other words, the developing rollers 101W, 101Y, 101C, 101M, and 101K develop the latent images on the photosensitive drums 12W, 12Y, 12C, 12M, and 12K with the toners respectively.

The intermediate transfer belt 51 rotates by rotation of the drive rollers 53*a* and 53*b* in a direction of arrow D2, and the toner images formed on the surface of the photosensitive drums 12W, 12Y, 12C, 12M, and 12K are transferred, by the first transfer rollers 52W, 52Y, 52C, 52M, and 52K onto the intermediate transfer belt 51, in that order from upstream side to downstream side in a moving direction of the intermediate transfer belt 51.

The recording medium P is supplied by the rotation of the paper feed roller 32 in a direction of arrow D3 and is conveyed by the pair of conveying rollers 33 to the position of the second transfer rollers 54*a* and 54*b*. The second transfer roller 54*a* and 54 are applied a voltage by the transfer controller 412, and when the recording medium P passes the second transfer rollers 54*a* and 54*b*, the toner images transferred onto the intermediate transfer belt 51 are transferred onto the recording medium P by the second transfer rollers 54*a* and 54*b*.

The recording medium P on which the toner images are transferred is conveyed to the position of the fixing unit 60, and the toner images are fixed on the recording medium P by heat and pressure applied by the heat roller 61 and the pressure roller 62. The recording medium P on which the toner images are fixed is discharged by the discharge roller unit 71 through a discharge opening onto the discharge cassette 70. In this way, the operation of forming the image on the recording medium P finishes.

Examples of control biases (voltages) applied to elements of the image forming unit using the spot color toner and elements of the image forming units using toners other than the spot color toner during the image forming operation will next be described. In the first embodiment, the image forming unit using toner (first developer) other than the spot color toner will be referred to as a first image forming unit, and the image forming unit using the spot color toner (second developer) will be referred to as a second image forming unit.

Control biases applied to the image forming units (for example, the image forming units 10Y, 10C, 10M, and 10K) which use toners other than the spot color toner may vary, but the relationship in control bias between the image forming unit (first image forming unit), which uses a toner other than the spot color toner, and the image forming unit (second image forming unit), which uses the spot color toner, is common between any of the first image forming unit and the second image forming unit. For example, the control biases applied to the image forming unit 10K and 10Y may be different to each other, but a relationship between control biases in the image forming unit 10K and control biases in the image forming unit 10W and a relationship between control biases in the image forming unit 10Y and control biases in the image forming unit 10W are common to each other. Accordingly, in the first embodiment, as an example of control biases in the first image forming unit, control biases in the image forming unit 10K will be described. Likewise, the control biases applied to the image forming unit which uses the metallic color and the image forming unit 10W which uses white toner may be different to each other, but as an example of control biases in the second image forming unit in the first embodiment, control biases in the image forming unit 10W will be described.

Control Operation in Comparative Example

Figure 4:
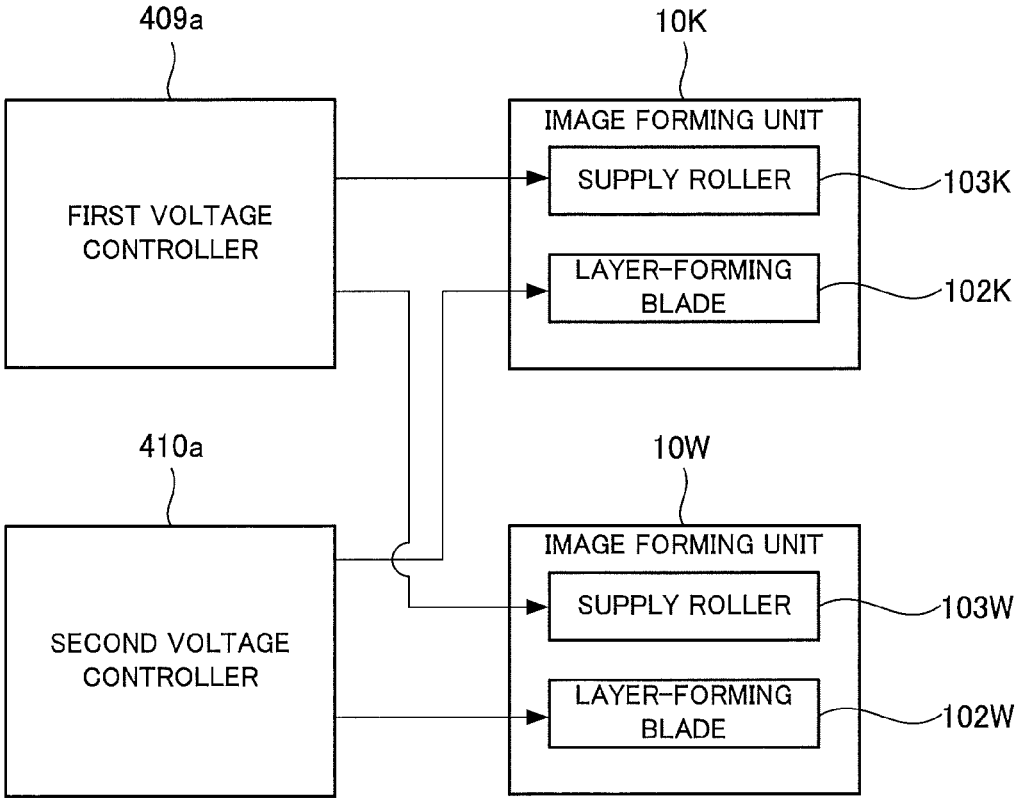
FIG. 4 is a block diagram showing the relationship among a first voltage controller, a second voltage controller, and image forming units in a comparative example.

Control operation in the image forming units 10K and 10W in the comparative example will be described first. FIG. 4 is a block diagram showing the relationship among the first voltage controller, the second voltage controller, and image forming units (image forming units 10K and 10W in FIG. 4) in the comparative example.

The control operation of the image forming unit 10K will be described first. When the image forming unit 10K starts an image forming operation, the developing-voltage controller 408 applies a developing voltage (DC voltage) (hereafter also referred to as a developing bias) of −200 V to the developing roller 101K. The first voltage controller 409*a* applies a supply voltage (hereafter also referred to as a supply bias) of −300 V (the same polarity as the polarity of the first developing voltage) to the supply roller 103K.

The second voltage controller 410*a* applies a layer-forming voltage (DC voltage) (hereafter also referred to as a layer-forming bias) of −150 V to the layer-forming blade 102K. The charging-voltage controller 411 applies a charging voltage (hereafter also referred to as a charging bias) of −1200 V to the charging roller 13K, and the surface of the photosensitive drum 12K is charged so that surface potential of the photosensitive drum 12K becomes −650 V.

When the black toner used in the image forming unit 10K is carried by the developing roller 101K and passes the layer-forming blade 102K, the charge amount of the black toner per unit weight becomes −25 μC/g. Since the black toner that has passed the layer-forming blade 102K is negatively polarized, the black toner carried by the developing roller 101K adheres to the surface (an area exposed in accordance with image data, for example) of the photosensitive drum 12K, resulting from the difference between the developing bias of the developing roller 101K and the surface potential of the photosensitive drum 12K. The charge amount of toner per unit weight Q/M μC/g (hereafter also referred to simply as charge amount) was measured by using absorption-type small charge-to-mass ratio system Model 212HS of TREK Japan Co. Ltd.

The control operation of the image forming unit 10W in the comparative example will next be described. When the image forming unit 10W starts image forming operation, the developing-voltage controller 408 applies a developing bias of −200 V to the developing roller 101W. The first voltage controller 409*a* applies a supply bias of −300 V (the same polarity as the polarity of the second developing voltage) to the supply roller 103W.

The second voltage controller 410*a* applies a layer-forming bias of −150 V to the layer-forming blade 102W. The charging-voltage controller 411 applies a charging bias of −1000 V to the charging roller 13W, and the surface of the photosensitive drum 12W is charged so that the surface potential of the photosensitive drum 12W becomes −420 V.

When the white toner used in the image forming unit 10W is carried by the developing roller 101W and passes the layer-forming blade 102W, the charge amount of the white toner per unit weight becomes −4.4 μC/g. Since the white toner that has passed the layer-forming blade 102W is negatively polarized, the white toner carried by the developing roller 101W adheres to the surface (an area exposed in accordance with image data, for example) of the photosensitive drum 12W, resulting from the difference between the developing bias of the developing roller 101W and the surface potential of the photosensitive drum 12W.

In the comparative example, the developing biases applied to the developing rollers 101K and 101W are the same in terms of magnitude, and the layer-forming biases applied to the layer-forming blades 102K and 102W are also the same in magnitude. Since white toner has weaker charging characteristics than black toner, it is supposed that the charge amount per unit weight of the white toner which has passed the layer-forming blade 102W becomes lower (the absolute value of the charge amount becomes smaller) than the charge amount per unit weight of the black toner which has passed the layer-forming blade 102K. In the present application, the "charging characteristics" is a character specific to the toner, expressed in charge amount per unit weight Q/M μC/g of toner when a predetermined voltage is applied. "Weak charging characteristics" in the present application means that the absolute value of the charge amount per unit weight Q/M μC/g of the toner is small when a predetermined voltage is applied, and "strong charging characteristics" means that the absolute value of the charge amount per unit weight Q/M μC/g of the toner is large when a predetermined voltage is applied.

An experiment was carried out to compare the charge amount of the white toner used in the first embodiment and the charge amount of toners of the other colors. More specifically, the white toner and the toners (cyan toner, yellow toner, and magenta toners) other than the white toner were adheres to rollers to which the same voltage was applied, and their charge amounts were measured with a charge amount measuring device (absorption-type small charge-to-mass ratio system Model 212HS of TREK Japan Co. Ltd.). In the measurement results, the charge amount of the white toner was −6 μC/g, the charge amount of the cyan toner, yellow toner, and magenta toner was −30 μC/g, which means that the charge amount of the white toner is smaller (the absolute value of the charge amount is smaller) than that of the other toners. These results indicate that the white toner used in the first embodiment is more conductive than the other toners and consequently has weaker charging characteristics.

Since the experiment of measuring the charge amount assures that white toner has weaker charging characteristics than black toner, it can be said that the charge amount per unit weight of the white toner which has passed the layer-forming blade 102W becomes lower than the charge amount per unit weight of the black toner which has passed the layer-forming blade 102K. Therefore, in the control operation as in the comparative example, fogging tends to occur when an image is formed by the image forming unit 10W.

Control Operation in First Embodiment

Figure 5:
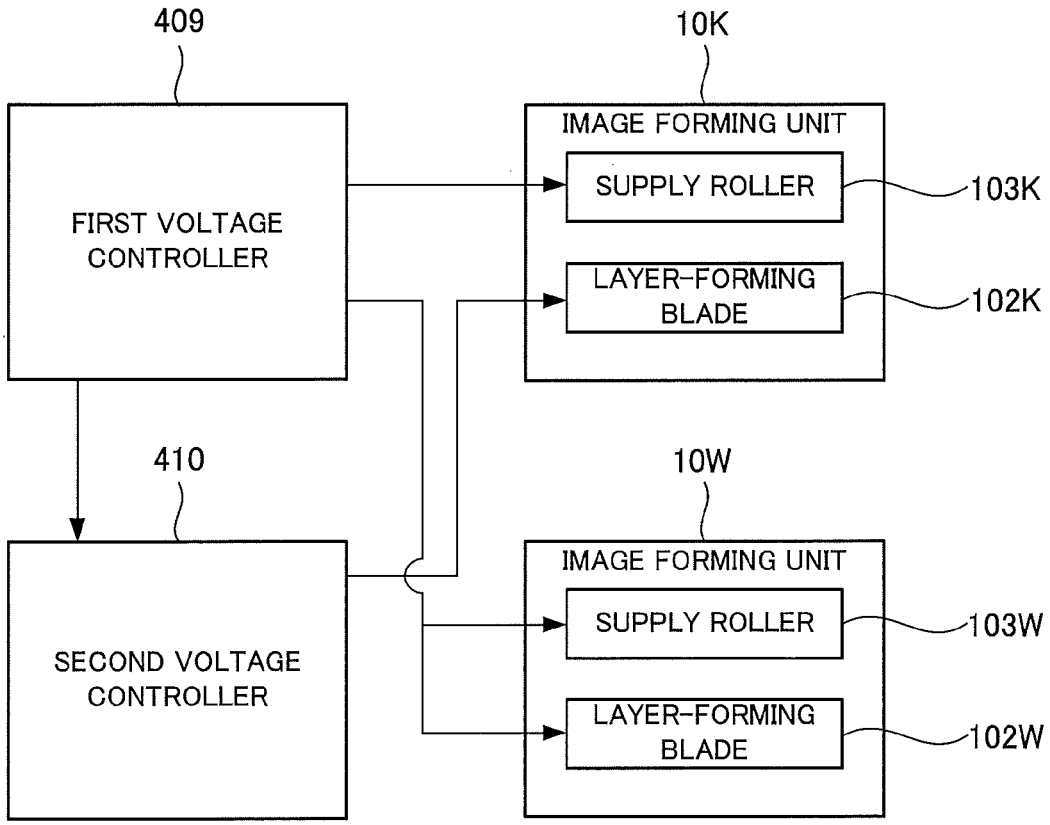
FIG. 5 is a block diagram showing the relationship among a first voltage controller, a second voltage controller, a first image forming unit, and a second image forming unit in the first embodiment.

Control operation in the image forming unit 10K (first image forming unit) and in the image forming unit 10W (second image forming unit) in the first embodiment will next be described. FIG. 5 is a block diagram showing the relationship among the first voltage controller, the second voltage controller, the first image forming unit (image forming unit 10K in FIG. 5), and the second image forming unit (image forming unit 10W in FIG. 5) in the first embodiment.

Control operation of the image forming unit 10K will be described first. When the image forming unit 10K starts image forming operation, the developing-voltage controller 408 applies a developing bias (DC voltage) (first developing voltage) of −200 V, for example, to the developing roller 101K (first developer carrier). The first voltage controller 409 applies a supply bias (first supply voltage) of −300 V, for example, to the supply roller 103K (first supply member). The toner (first developer) is supplied from the supply roller 103K to the developing roller 101K by applying the supply bias and the developing bias having the same polarity and by setting the supply bias and the developing bias so that the absolute value of the supply bias is greater than the absolute value of the developing bias.

The first voltage controller 409 and the second voltage controller 410 are connected through a Zener diode and so on, and the second voltage controller 410 applies a bias (DC voltage) (first layer-forming voltage) having the same polarity as the developing bias (first developing voltage) to the layer-forming blade 102K (first layer-forming member). The layer-forming blade 102K is supplied a layer-forming bias (first layer-forming voltage) of −150 V, for example. The charging-voltage controller 411 applies a charging bias (first charging voltage) of −1200 V, for example, to the charging roller 13K (first charging member), and the surface of the photosensitive drum 12K (first image carrier) is charged so that the surface potential of the photosensitive drum 12K becomes −650 V, for example.

When the black toner used in the image forming unit 10K is carried by the developing roller 101K and passes the layer-forming blade 102K, the charge amount of the black toner per unit weight becomes −25 μC/g, for example. Since the black toner that has passed the layer-forming blade 102K is negatively polarized, the black toner carried by the developing roller 101K adheres to the surface (an area exposed in accordance with image data, for example) of the photosensitive drum 12K, resulting from the difference between the developing bias of the developing roller 101K and the surface potential of the photosensitive drum 12K. However, the control biases in the image forming unit 10K are not limited to the example given above.

It is preferable that biases in the image forming unit 10K be set so that the charge amount per unit weight Q/M μC/g of the black toner that has passed the layer-forming blade 102K satisfies a condition given below.

$$-20\ [\mu C/g] \leq Q/M\ [\mu C/g] \leq -35\ [\mu C/g]$$

In a case where Vbb [V] is the layer-forming bias applied to the layer-forming blade 102K and Vdb [V] is the developing bias applied to the developing roller 101K in the image forming unit 10K, it is preferable that the layer-forming bias Vbb [V] applied to the layer-forming blade 102K and the developing bias Vdb [V] applied to the developing roller 101K be set to satisfy a condition (1).

$$0\ [V] \leq (Vbb-Vdb)\ [V] \leq +100\ [V] \quad (1)$$

In a case where the value calculated by (Vbb−Vdb) is smaller than 0 V, which is the lower limit in the condition (1) (for example, in a case where (Vbb−Vdb)=−100 V), the charge amount of the black toner that has passed the layer-forming blade 102K would be too high (that is, the absolute value of the charge amount would be too large). By performing such control operation that the value calculated by (Vbb−Vdb) is 0 V or more, the charge amount of the black toner that has passed the layer-forming blade 102K can be reduced to a low level (that is, the absolute value of the charge amount can be reduced to a small value).

In a case where the value calculated by (Vbb−Vdb) exceeds +100 V, which is the upper limit in the condition (1) (for example, in a case where (Vbb−Vdb)=+200 V), the charge amount of the black toner that has passed the layer-forming blade 102K would be too low (there are cases where the charge amount approaches zero), and the black toner could not adhere to the photosensitive drum 12K from the developing roller 101K appropriately.

When the value calculated by (Vbb−Vdb) satisfies the condition (1), the amount of the black toner adhered to the photosensitive drum 12K from the developing roller 101K, per unit area of the surface of the photosensitive drum 12K becomes appropriate in the image forming unit 10K.

The first embodiment has been described by showing an example in which negative control voltage is applied to the elements of the image forming unit 10K, but the present invention can be applied even if positive control voltage is applied to the elements of the image forming units in the image forming apparatus 1. In a case where the present invention is applied to a configuration in which positive control voltage is applied to elements in the image forming units, the present invention can be applied by replacing the condition (1) with a condition (1a).

$$-100\ [V] \leq (Vbb-Vdb)\ [V] \leq 0\ [V] \quad (1a)$$

An example of control of the image forming unit 10W in the first embodiment will next be described. When the image forming unit 10W starts image forming operation, the developing-voltage controller 408 applies a developing bias (DC voltage) (second developing voltage) of −170 V to the developing roller 101W (second developer carrier), for example. The first voltage controller 409 applies a supply bias (second supply voltage) of −370 V, for example, to the supply roller 103W (second supply member). The toner (second developer) is supplied from the supply roller 103W to the developing roller 101W by applying the supply bias and developing bias having the same polarity and by setting the supply bias and the developing bias so that the absolute value of the supply bias is greater than the absolute value of the developing bias.

The first voltage controller 409 applies a bias (DC voltage) (second layer-forming voltage) having the same polarity as the developing bias (second developing voltage), to the layer-forming blade 102W (second layer-forming member). The layer-forming blade 102W is applied with a layer-forming bias (second layer-forming voltage) of −370 V, for example. The charging-voltage controller 411 applies a charging bias (second charging voltage) of −970 V, for example, to the charging roller 13W (second charging member), and the surface of the photosensitive drum 12W (second image carrier) is charged so that the surface potential of the photosensitive drum 12W becomes −420 V, for example.

When the white toner used in the image forming unit 10W is carried by the developing roller 101W and passes the layer-forming blade 102W, the charge amount of the white toner per unit weight becomes about −7.4 μC/g, for example. Since the white toner that has passed the layer-forming blade 102W is negatively polarized, the white toner carried by the developing roller 101W adheres to the surface (an area exposed in accordance with image data, for example) of the photosensitive drum 12W, resulting from the difference between the developing bias of the developing roller 101W and the surface potential of the photosensitive drum 12W. However, the control biases in the image forming unit 10W are not limited to the example given above.

The charging characteristics (second charging characteristics) of the white toner used in the image forming unit 10W are different from the charging characteristics (first charging characteristics) of the black toner used in the image forming unit 10K. Specifically, the charging characteristics (second charging characteristics) of the white toner used in the image forming unit 10W is weaker than the charging characteristics (first charging characteristics) of the black toner used in the image forming unit 10K. Accordingly, the absolute value of the charge amount of the white toner that has passed between the layer-forming blade 102W and the developing roller 101W in the image forming unit 10W is smaller than the absolute value of the charge amount of the black toner that has passed between the layer-forming blade 102K and the developing roller 101K in the image forming unit 10K.

It is preferable that biases in the image forming unit 10W be set so that the absolute value |Q/M| of the charge amount per unit weight Q/M μC/g of the white toner that has passed the layer-forming blade 102W satisfies a condition given below.

$$5\ [\mu C/g] \leq |Q/M|\ [\mu C/g] \leq 10\ [\mu C/g]$$

Since the white toner used in the first embodiment is negatively polarized, it is preferable that biases in the image forming unit 10W be set to satisfy a condition given below.

$$-5\ [\mu C/g] \leq Q/M\ [\mu C/g] \leq 10\ [\mu C/g]$$

Figure 6:
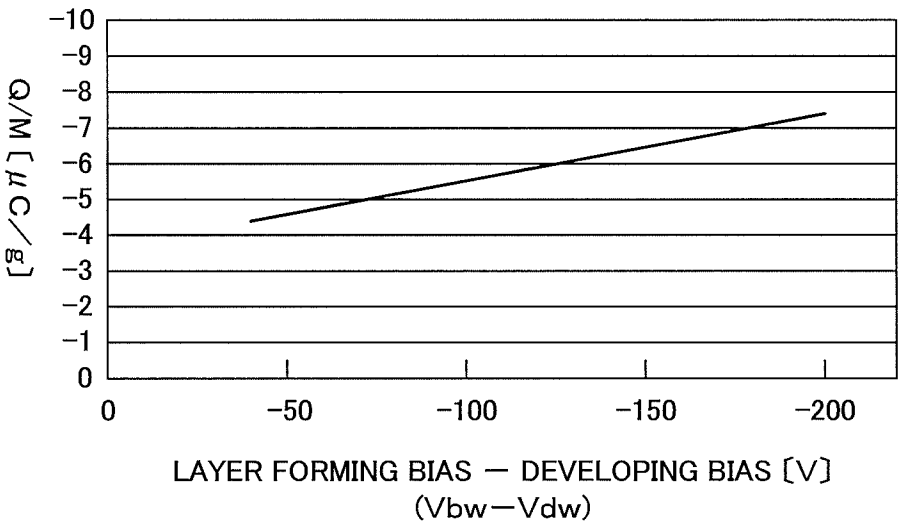
FIG. 6 is a diagram showing a relation in an image forming unit using a white toner, between the charge amount of the white toner on the developing roller and difference between a layer-forming bias of a layer-forming blade and a developing bias of the developing roller.

FIG. 6 is a diagram showing a relation in the image forming unit 10W using white toner, between the charge amount Q/M of white toner on the developing roller 101W and the difference between Vbw and Vdw (that is, Vbw−Vdw). Vbw is the layer-forming bias of the layer-forming blade 102W, and Vdw is the developing bias of the developing roller. FIG. 6 shows a graph of results obtained by actually measuring the charge amount of white toner. Absorption-type small charge-to-mass ratio system Model 212HS of TREK Japan Co., Ltd. was used to measure the charge amount Q/M μC/g. FIG. 6 indicates that when the difference (Vbw−Vdw) between the layer-forming bias Vbw and the developing bias Vdw is set to −200 V, for example, the charge amount of the white toner becomes about −7.4 μC/g.

Voltages applied to the elements of the image forming units 10K and 10W are set so that the absolute value |Vsb| of the supply bias applied to the supply roller 103K in the image forming unit 10K, the absolute value |Vdb| of the developing bias applied to the developing roller 101K, the absolute value |Vsw| of the supply bias applied to the supply roller 103W in the image forming unit 10W, and the absolute value Vdw of the developing bias applied to the developing roller 101W satisfy a condition (2) given below.

$$|Vsb|-|Vdb|<|Vsw|-Vdw \quad (2)$$

Since control biases in the image forming apparatus 1 are set so that the difference (|Vsw|−|Vdw|) between the absolute value |Vsw| of the supply bias and the absolute value Vdw of the developing bias in the image forming unit 10W using white toner, which is a spot color toner, becomes greater than the difference (|Vsb|−|Vdb|) between the absolute value |Vsb| of the supply bias and the absolute value |Vdb| of the developing bias, in the image forming unit 10K which uses a toner having higher charging characteristics than the spot color toner, unevenness in images by the white toner from the image forming unit 10W can be reduced, and the deterioration of image density by the white toner can be reduced, in comparison with images of the black toner from the image forming unit 10K. Since the amount of white toner supplied from the supply roller 103W to the developing roller 101W in the image forming unit 10W can be stabilized and since the image forming unit 10K can be controlled in such a manner that a remarkably large amount of black toner is not supplied from the supply roller 103K to the developing roller 101K, the amount of white toner supplied from the supply roller 103W to the developing roller 101W in the image forming unit 10W and the amount of black toner supplied from the supply roller 103K to the developing roller 101K in the image forming unit 10K can be set to appropriate levels.

It is preferable that the absolute value |Vdw| of the developing bias applied to the developing roller 101W in the image forming unit 10W be smaller than the absolute value |Vdb| of the developing bias applied to the developing roller 101K in the image forming unit 10K. Accordingly, the condition given by the condition (2) above can be satisfied even when supply biases |Vsb| and |Vsw| of the same level are applied to the supply rollers 103K and 103W.

Figure 7:
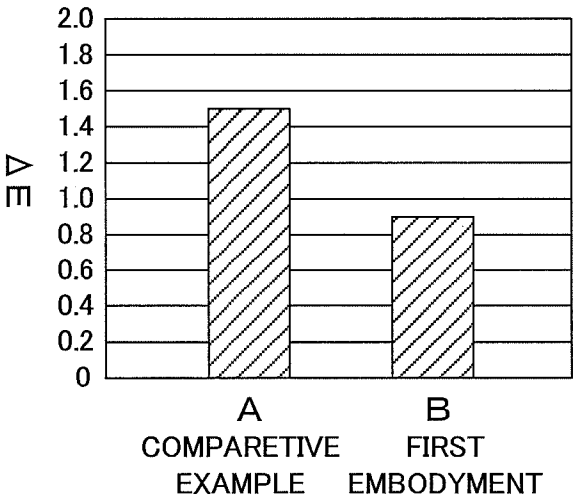
FIG. 7 is a diagram showing the results of measurement of color difference $\Delta E$ as an indicator indicating the degree of fogging, in cases where a control bias in the comparative example and a control bias in the first embodiment are used respectively.

FIG. 7 is a diagram showing the results of measurement of color difference ΔE as an indicator of the degree of fogging when the control biases in the comparative example are used and when the control biases in the first embodiment are used. In FIG. 7, "A" indicates color difference ΔE calculated on the basis of measurement results when the control biases in the image forming unit 10W as shown in "Control Operation in Comparative Example" above are used for printing, and "B" indicates color difference ΔE calculated on the basis of measurement results when the control biases in the image forming unit 10W as shown in "Control Operation in First Embodiment" above are used for printing. In FIG. 7, as the value of ΔE increases, the degree of fogging rises (the print quality is lowered).

Color difference ΔE was measured by using OHP film CG3600 by 3M Japan Limited as the medium to be printed and black paper (colored woodfree paper/black color/thick by Hokuetsu Kishu Paper Co., Ltd.) as an underlay of the medium to be printed and by using spectrophotometer CM-2600d by Konica Minolta Inc. Values ($L^*_1$, $a^*_1$, $b^*_1$) and ($L^*_2$, $a^*_2$, $b^*_2$) in the Lab color space (space based on coordinates (L*, a*, b*)) before and after the OHP film is printed were measured, and the measured values ($L^*_1$, $a^*_1$, $b^*_1$) and ($L^*_2$, $a^*_2$, $b^*_2$) were used and calculated as given by the calculation formula below.

$$\Delta E=\{(L^*_1-L^*_2)^2+(a^*_1-a^*_2)^2+(b^*_1-b^*_2)^2\}^{0.5}$$

As shown in FIG. 7, ΔE=1.5 is obtained in the comparative example ("A" in FIG. 7). When the control bias values indicated in the control operation in the first embodiment is used ("B" in FIG. 7), ΔE=0.9 is obtained. It means that color difference ΔE in the control operation in the first embodiment ("B" in FIG. 7) is improved by about 40% than that in the comparative example ("A" in FIG. 7). That is because the charge amount Q/M μC/g of the white toner on the developing roller 101W in the control operation in the first embodiment is −7.4 μC/g, which is higher than (that is, the absolute value of the charge amount is greater than) the charge amount (−4.4 μC/g) in the control operation in the comparative example.

As described above, according to the first embodiment, since the absolute value |Vbw| of the layer-forming voltage applied to the layer-forming blade 102W is greater than the absolute value of the voltage applied to the layer-forming blade of the image forming unit using toner other than the spot color toner, the charge amount (the absolute value of the charge amount) of the white toner can be greater.

Moreover, since it is configured so that the absolute value |Vbb| of the layer-forming bias applied to the layer-forming blade 102K is smaller than the absolute value |Vdb| of the developing bias applied to the developing roller 101K and the absolute value |Vbw| of the layer-forming bias applied to the layer-forming blade 102W is greater than the absolute value |Vdw| of the developing bias applied to the developing roller 101W, the charge amount of the black toner that has passed the layer-forming blade 102K can be suppressed to a low level (that is, the absolute value of the charge amount can be suppressed to a low level), and the charge amount of the white toner that has passed the layer-forming blade 102W can be raised (that is, the absolute value of the charge amount can be greater), and consequently fogging toner in the image forming unit 10W can be reduced. Therefore, the deterioration of image quality caused by the weak charging characteristics of the spot color toner can be suppressed.

More specifically, since the spot color toner such as white toner has weak charging characteristics, the spot color toner is controlled to be negatively charged by charge injection from the layer-forming blade 102W. Since toners other than the spot color toner, such as black toner, is more likely to be charged than the spot color toner, bias control is performed so that it becomes harder to generate the charge injection from the layer-forming blade 102K, and consequently, the difference between the charge amount of the spot color toner (second developer) and the charge amount of toners (first developer) other than the spot color toner can be reduced.

By the bias control operation described above, fogging toner in the image forming unit 10W can be reduced, and the deterioration of image quality caused by the weak charging characteristics of the spot color toner can be suppressed. Also, in the image forming apparatus 1 according to the first embodiment, the amount of white toner per unit area on the surface of the photosensitive drum 12W, adhered from the developing roller 101W to the photosensitive drum 12W in the image forming unit 10W, can be stabilized, thereby the amount per unit area of black toner adhered from the developing roller 101K to the photosensitive drum 12K in the image forming unit 10K can be controlled not to increase to a remarkably high level. That is, according to the first embodiment, the image forming apparatus 1 that can keep the amount of white toner per unit area on the surface of the photosensitive drum 12W, adhered from the developing roller 101W to the photosensitive drum 12W in the image forming unit 10W, and the amount of black toner per unit area, adhered from the developing roller 101K to the photosensitive drum 12K in the image forming unit 10K to appropriate levels can be provided.

In the first embodiment, the control operation of the image forming unit other than the image forming unit 10W has been described by taking the image forming unit 10K as an example, and the control operation described in the image forming unit 10K can be applied to the image forming units other than the image forming unit 10W, such as the image forming units 10Y, 10C, 10M. The control operation in the image forming unit 10W described above can be applied to the image forming unit using metallic color toner.

Second Embodiment

An image forming apparatus 1 according to a second embodiment has the same basic configuration as the image forming apparatus 1 described in the first embodiment, and just a layer-forming bias applied to the layer-forming blade 102K in the image forming unit 10K differs from the control biases described in the first embodiment. Therefore, in the description of the second embodiment, the drawings referred to in the first embodiment will be referred to, and components identical to or corresponding to those in the first embodiment will be described by using the same reference numerals.

For the same reason as described earlier (in the first embodiment), control biases in the image forming unit 10K will be described as control biases in the first image forming unit in the second embodiment. Likewise, control biases in the image forming unit 10W will be described as control biases in the second image forming unit.

The control operation of the image forming unit 10K (first image forming unit) in the second embodiment will next be described. When the image forming unit 10K starts image forming operation, the developing-voltage controller 408 applies a developing bias (DC voltage) of −200 V, for example, to the developing roller 101K. The first voltage controller 409 applies a supply bias of −300 V, for example, to the supply roller 103K. The toner is supplied from the supply roller 103K to the developing roller 101K by applying the supply bias and developing bias having the same polarity and by setting the supply bias and the developing bias so that the absolute value of the supply bias is greater than the absolute value of the developing bias.

The first voltage controller 409 and the second voltage controller 410 are connected through a Zener diode and so on, and the second voltage controller 410 applies a bias (DC voltage) having the same polarity as the developing bias to the layer-forming blade 102K. The layer-forming blade 102K is applied a layer-forming bias of −210 V, for example. The charging-voltage controller 411 applies a charging bias of −1200 V, for example, to the charging roller 13K, and the surface of the photosensitive drum 12K is charged so that the surface potential of the photosensitive drum 12K becomes −650 V, for example.

When the black toner used in the image forming unit 10K is carried by the developing roller 101K and passes the layer-forming blade 102K, the charge amount of the black toner per unit weight becomes −25 μC/g, for example. Since the black toner that has passed the layer-forming blade 102K is negatively polarized, the black toner carried by the developing roller 101K adheres to the surface (an area exposed in accordance with image data, for example) of the photosensitive drum 12K, caused by the difference between the developing bias of the developing roller 101K and the surface potential of the photosensitive drum 12K. However, the control biases in the image forming unit 10K are not limited to the example given above.

It is preferable that biases in the image forming unit 10K be set so that the charge amount per unit weight Q/M μC/g of the black toner that has passed the layer-forming blade 102K satisfies a condition given below.

$$-20\ [\mu C/g] \leq Q/M\ [\mu C/g] \leq -35\ [\mu C/g]$$

In the image forming unit 10K of the image forming apparatus 1 according to the second embodiment, the layer-forming bias applied to the layer-forming blade 102K differs from the layer-forming bias in the image forming unit 10K of the image forming apparatus 1 according to the first embodiment. In the image forming unit 10K of the image forming apparatus 1 according to the second embodiment, the absolute value |Vbb| of the layer-forming bias applied to the layer-forming blade 102K is greater than the absolute value |Vdb| of the developing bias applied to the developing roller 101K. In this case, the layer-forming blade 102K in the image forming unit 10K may cause the charge injection to the black toner, causing the charge amount of the black toner to exceed the charge amount of the white toner (that is, the absolute value of the charge amount increases), increasing the difference between the charge amount of the black toner and the charge amount of the white toner. Accordingly, the elements in the image forming unit 10W (second image forming unit), which uses white toner, are controlled so that the condition described later is satisfied in the image forming unit 10W.

In the image forming unit 10W of the image forming apparatus 1 according to the second embodiment, as well as the image forming unit 10W of the image forming apparatus 1 according to the first embodiment, the absolute value |Vbw| of the layer-forming bias applied to the layer-forming blade 102W is greater than the absolute value |Vdw| of the developing bias applied to the developing roller 101W.

In the second embodiment, the control biases in the image forming units 10K and 10W are set so that the absolute value |Vbb| of the layer-forming bias applied to the layer-forming blade 102K, the absolute value |Vdb| of the developing bias applied to the developing roller 101K, the absolute value |Vbw| of the layer-forming bias applied to the layer-forming blade 102W, and the absolute value |Vdw| of the developing bias applied to the developing roller 101W satisfy the condition given by the following condition:

$$|Vbb|-|Vdb|<|Vbw|-|Vdw|$$

Also, it is preferable that the layer-forming bias applied to the layer-forming blade 102W and the developing bias applied to the developing roller 101W set so that the the relationship between the absolute value |Vbw| of the layer-forming bias applied to the layer-forming blade 102W and the absolute value |Vdw| of the developing bias applied to the developing roller 101W satisfies following condition (3).

$$0\ [V]<(|Vbw|-|Vdw|)\ [V]\leq 400\ [V] \quad (3)$$

Especially, it is preferable that the layer-forming bias applied to the layer-forming blade 102W and the developing bias applied to the developing roller 101W set to satisfy following condition (4).

$$100\ [V]\leq(|Vbw|-|Vdw|)\ [V]\leq 300\ [V] \quad (4)$$

When the settings are made so that the value calculated by (|Vbw|−|Vdw|) exceeds the lower limit of 0 V, as shown in the condition (3), the charge injection is easily generated, and the charge amount of the white toner that has passed the layer-forming blade 102W can be raised (that is, the absolute value of the charge amount can be greater).

Since the charge amount of the white toner reaches a given level of saturated charge amount, even if the layer-forming bias to be applied to the layer-forming blade 102W and the developing bias to be applied to the developing roller 101W are set in the second embodiment so that the value calculated by (|Vbw|−|Vdw|) exceeds 400 V, the charge amount of the white toner does not vary greatly, and the power consumption increases. Therefore, it is preferable that the layer-forming bias to be applied to the layer-forming blade 102W and the developing bias to be applied to the developing roller 101W be set to such values that the value calculated by (|Vbw|−|Vdw|) does not exceed the upper limit value of 400 V, as indicated by the condition (3).

In a case where the value calculated by (|Vbw|−|Vdw|) does not fall below a desired lower limit value of 100 V, as indicated by the condition (4), the charge amount of the white toner that has passed the layer-forming blade 102W can be raised further (that is, the absolute value of the charge amount can be greater further) by the charge injection. In a case where the value calculated by (|Vbw|−|Vdw|) does not exceed a desired upper limit value of 300 V, as indicated by the condition (4), the effect of suppressing the power consumption can be obtained.

If the layer-forming bias and the developing bias in the image forming unit 10W are set to satisfy the condition given by the condition (3) or (4), voltage applied to the other elements in the image forming unit 10W may be set appropriately in consideration of the set layer-forming bias and developing bias.

According to the second embodiment, since the difference (|Vbw|−|Vdw|) between the absolute value |Vbw| of the layer-forming bias applied to the layer-forming blade 102W and the absolute value |Vdw| of the developing bias applied to the developing roller 101W is greater than the difference (|Vbb|−|Vdb|) between the absolute value |Vbb| of the layer-forming bias applied to the layer-forming blade 102K and the absolute value |Vdb| of the developing bias applied to the developing roller 101K, the amount of white toner, adhered from the developing roller 101W to the photosensitive drum 12W in the image forming unit 10W, per unit area on the surface of the photosensitive drum 12W can be stabilized. In addition, the amount of black toner, attached from the developing roller 101K to the photosensitive drum 12K in the image forming unit 10K, per unit area can be controlled not to increase remarkably. In other words, the amount of white toner, adhered from the developing roller 101W to the photosensitive drum 12W in the image forming unit 10W, per unit area on the surface of the photosensitive drum 12W and the amount of black toner, adhered from the developing roller 101K to the photosensitive drum 12K in the image forming unit 10K, per unit area can be set to appropriate values.

Also, in a state in which the absolute value |Vbb| of the layer-forming bias applied to the layer-forming blade 102K is set to fall below the absolute value |Vdb| of the developing bias applied to the developing roller 101K and the absolute value |Vbw| of the layer-forming bias applied to the layer-forming blade 102W is set to exceed the absolute value |Vdw| of the developing bias applied to the developing roller 101W, it is further preferred that the difference (|Vbw|−|Vdw|) between the absolute value |Vbw| of the layer-forming bias applied to the layer-forming blade 102W and the absolute value |Vdw| of the developing bias applied to the developing roller 101W is greater than the difference (|Vbb|−|Vdb|) between the absolute value |Vbb| of the layer-forming bias applied to the layer-forming blade 102K and the absolute value |Vdb| of the developing bias applied to the developing roller 101K. According to a configuration, since the charge amount of the black toner that has passed the layer-forming blade 102K is held to low level (that is, the absolute value of the charge amount is held to a small value) and the charge amount of the white toner that has passed the layer-forming blade 102W can be raised (that is, the absolute value of the charge amount can be greater), the amount of white toner, adhered from the developing roller 101W to the photosensitive drum 12W in the image forming unit 10W, per unit area on the surface of the photosensitive drum 12W and the amount of black toner, adhered from the developing roller 101K to the photosensitive drum 12K in the image forming unit 10K, per unit area can be set to appropriate values, and the densities of color toner images can be set appropriately.

Third Embodiment

An image forming apparatus 1*a* according to a third embodiment has the same basic configuration as the image forming apparatus 1 described in the first and second embodiments, and the difference from a configuration of the image forming apparatus 1 according to the first or second embodiment lies in that the control unit 4*a* includes a third voltage controller 415 and that a spot color toner and a transparent toner (hereafter also referred to as a clear toner) are exchangeable. Therefore, in the description of the third embodiment, components identical to or corresponding to components in the first embodiment will be described by using the same reference numerals. The basic configurations of elements of an image forming unit 10CL, which uses a clear toner, is the same as that of the image forming units 10W and 10K described in the first and second embodiments, but control biases applied to the elements of the image forming unit 10CL may differ from the control biases applied to the elements of the image forming units 10W and 10K.

Figure 8:
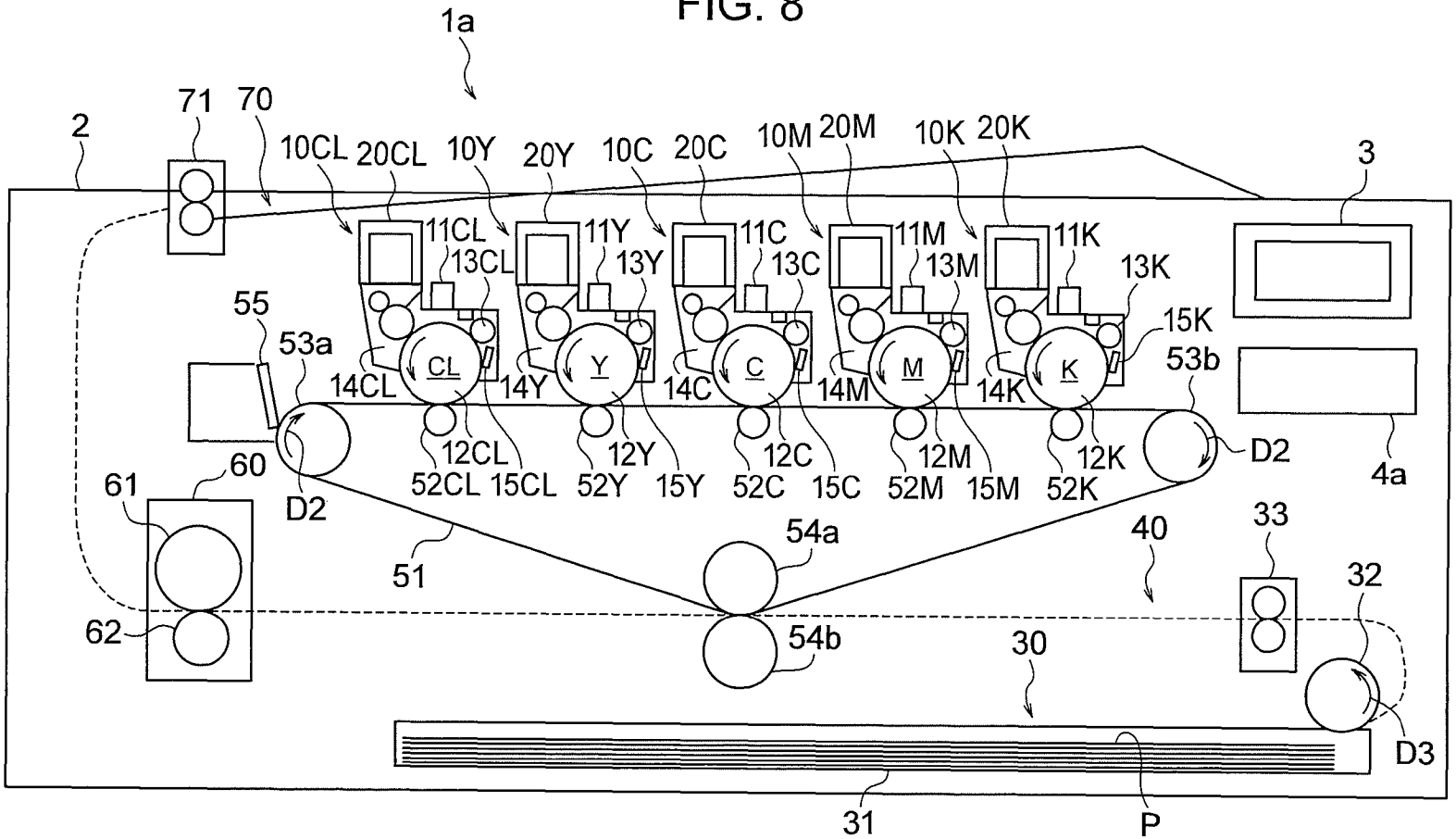
FIG. 8 is a longitudinal sectional view schematically showing a configuration of an image forming apparatus according to a third embodiment of the present invention.
Figure 9:
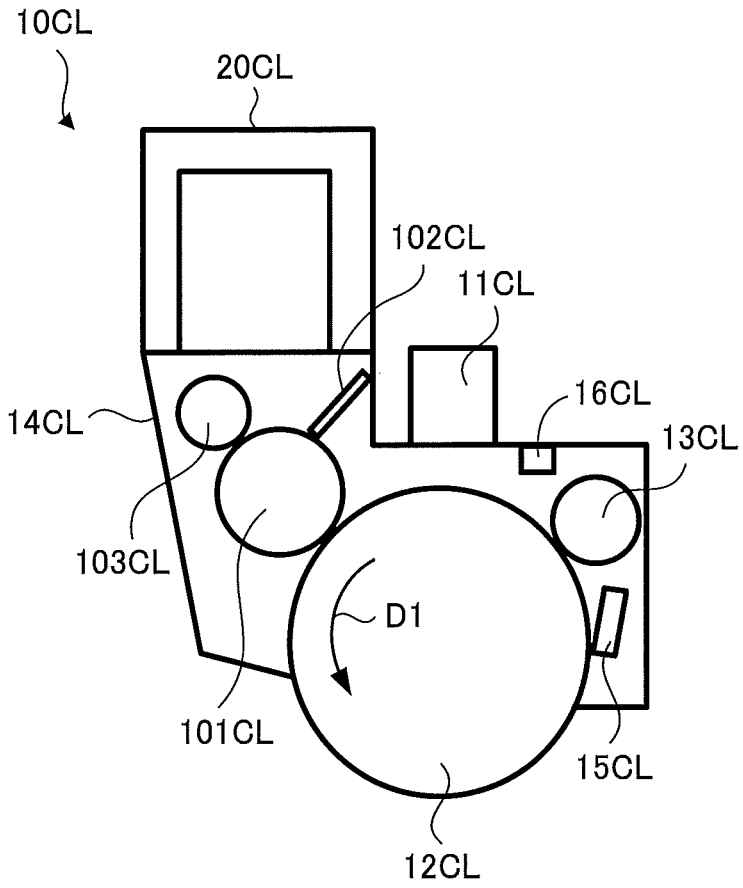
FIG. 9 is an enlarged sectional view schematically showing a configuration of an image forming unit which uses a clear toner.
Figure 10:
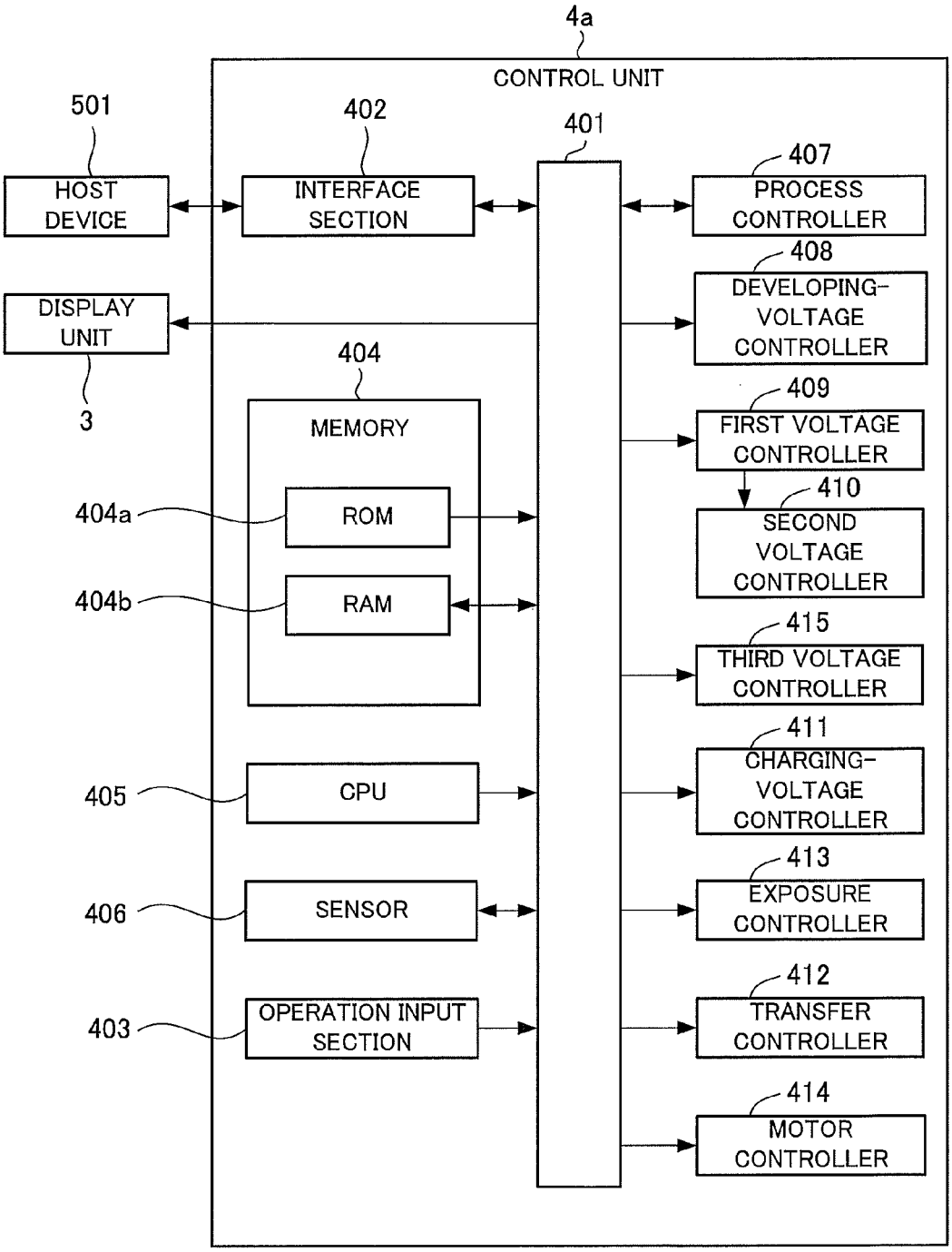
FIG. 10 is a block diagram showing a control system of the image forming apparatus according to the third embodiment.
Figure 11:
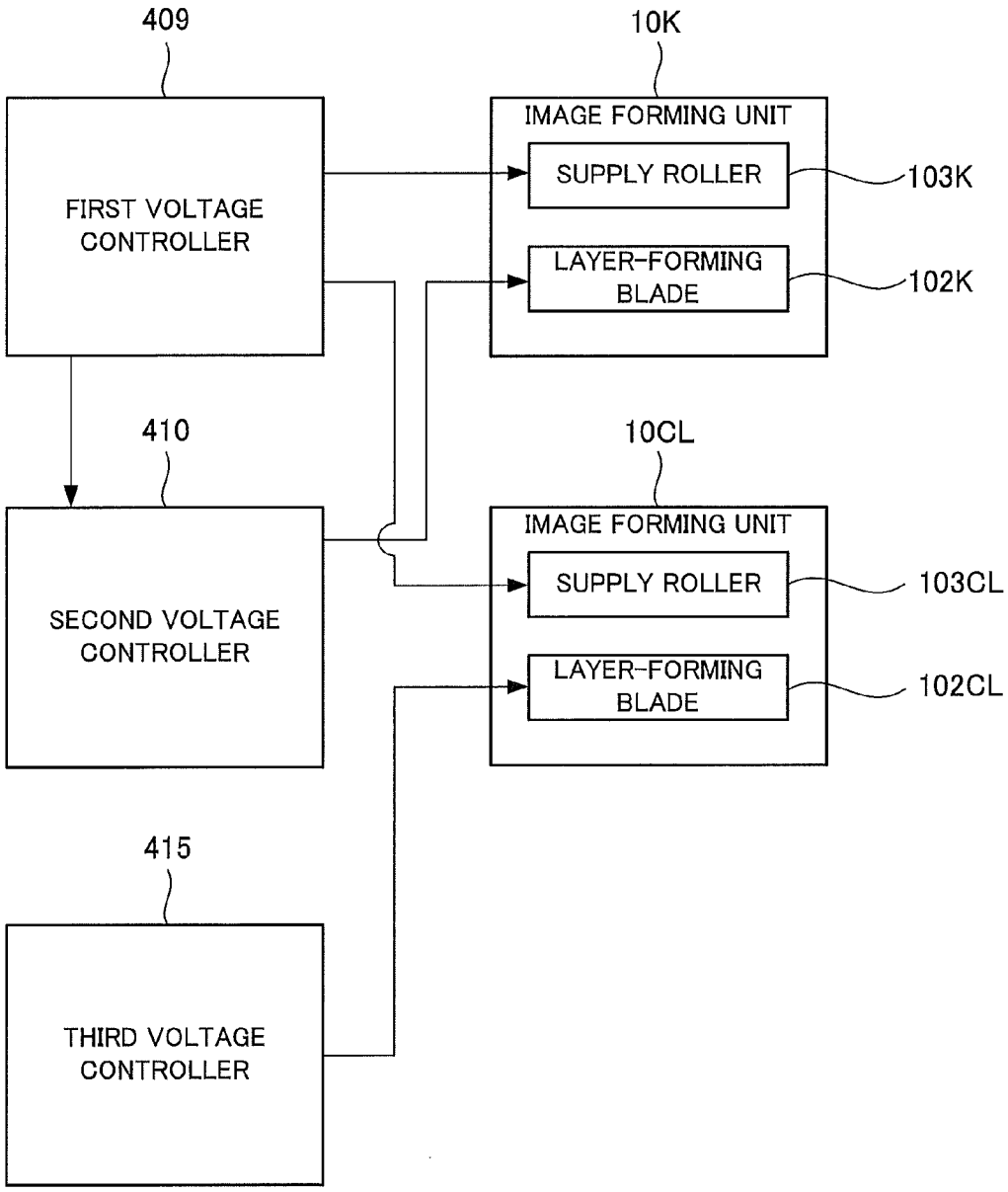
FIG. 11 is a block diagram showing the relationship among a first voltage controller, a second voltage controller, a third voltage controller, and image forming units in the third embodiment.

FIG. 8 is a longitudinal sectional view schematically showing a configuration of the image forming apparatus 1*a* according to the third embodiment of the present invention. FIG. 9 is an enlarged sectional view schematically showing a configuration of the image forming unit 10CL in the third embodiment. FIG. 10 is a block diagram showing the control system of the image forming apparatus 1*a* according to the third embodiment. FIG. 11 is a block diagram showing the relationship among a first voltage controller, a second voltage controller, a third voltage controller, and image forming units in the third embodiment.

In the image forming apparatus 1*a* according to the third embodiment, either the image forming unit 10W, which uses white toner, or the image forming unit 10CL, which uses clear toner, can be selectively mounted to the same mounting position of the image forming unit. The user is also allowed to make a unit replacement of removing the image forming unit 10W from the image forming apparatus 1*a* and mounting the image forming unit 10CL to the same mounting position or another unit replacement of removing the image forming unit 10CL from the image forming apparatus 1*a* and mounting the image forming unit 10W to the same mounting position.

Clear toner is a toner containing a polyester resin, a colorant, a charge control agent, a release agent, and so on, and the colorant contained in the toner contains an amount of fluorescent coloring agent or the like that can cancel out the color tone intrinsic to the base resin. The clear toner may also contain an external additive (for example, hydrophobic silica). It is preferable that the clear toner used in the third embodiment have a pulverized grain shape obtained by the pulverization method and an average particle diameter of about 8 μm, for example. The clear toner used in the third embodiment may also be a toner produced by other methods such as the polymerization method.

The user can exchange the image forming unit 10W for the image forming unit 10CL at an arbitrary timing, for example, when the image forming operation is suspended. In the image forming apparatus 1*a*, the white toner and the clear toner are exchangeable. The color of the toner used in the image forming apparatus 1*a* can be changed between the white toner and the clear toner, by exchanging the image forming unit 10W and toner cartridge 20W, which use white toner, for the image forming unit 10CL and toner cartridge 20CL, which use clear toner. In the third embodiment, an example using white toner, yellow toner, cyan toner, magenta toner, and black toner will be described, but toners of desired colors can be used as the toners other than white toner or clear toner.

FIG. 8 shows the image forming apparatus 1*a* in which the image forming unit and the toner cartridge have been switched from the image forming unit 10W and toner cartridge 20W, which use white toners, to the image forming unit 10CL and toner cartridge 20CL, which use clear toners. The image forming units 10CL, 10W, 10Y, 10C, 10M, and 10K include identification memories 16CL, 16W, 16Y, 16C, 16M, and 16K which identify the types (for example, toner colors) of the corresponding image forming units respectively. For example, in a case where the image forming unit 10W is taken out of the image forming apparatus 1 and the image forming unit 10CL is mounted, the image forming apparatus 1*a* recognizes that the image forming unit CL has been mounted, on the basis of the information (for example, information identifying the type of the image forming unit) stored in the identification memory 16CL of the image forming unit 10CL, and appropriate control operation is performed in the image forming unit 10CL.

As shown in FIG. 8, the image forming units 10CL, 10Y, 10C, 10M, and 10K are arranged in that order from an upstream side to a downstream side in the direction of rotation of the intermediate transfer belt 51. FIG. 8 shows five image forming units 10CL, 10Y, 10C, 10M, and 10K and five toner cartridges 20CL, 20Y, 20C, 20M, and 20K, but the number of image forming units and the number of toner cartridges included in the image forming apparatus 1*a* may be two to four and may also be six or more. The present invention can be applied to other types of electronic equipment utilizing electrophotography, including electronic equipment such as copiers, facsimile apparatuses, and multifunction peripheral (MFP) devices.

As shown in FIGS. 8 and 9, the image forming unit 10CL includes an LED head 11CL as an exposure device, a photosensitive drum 12CL as an image carrier which is rotatably supported, a charging roller 13CL as a charging member for uniformly charging the surface of the photosensitive drum 12CL. The image forming unit 10CL further includes a developing device 14CL which forms a toner image corresponding to the electrostatic latent image by supplying toner to the surface of the photosensitive drum 12CL after forming an electrostatic latent image on the surface of the photosensitive drum 12CL by exposure with the LED head 11CL, and a cleaning blade 15CL which cleans the surface of the photosensitive drum 12CL.

As shown in FIG. 9, the developing device 14CL includes a toner storage member which forms a developer storage space for storing the toner, a developing roller 101CL which supplies toner onto the surface of the photosensitive drum 12CL, a layer-forming blade 102CL as a layer-forming member for regulating thickness of a toner layer carried by the developing roller 101CL, and a supply roller 103CL which supplies the toner stored in the toner storage member to the developing roller 101CL. The configurations of the image forming units 10CL and developing device 14CL are not limited to the examples given above, and other configurations may be used. The materials, structures, and shapes of these elements in the image forming unit 10CL may be the same as the materials, structures, and shapes of the elements of the image forming units 10W, 10Y, 10C, 10M, and 10K described in the first embodiment.

As shown in FIG. 10, the image forming apparatus 1*a* is controlled mainly by a control unit 4*a*. The configuration and function of the control unit 4*a* are basically the same as those of the control unit 4 described in the first embodiment, but the control unit 4*a* in the third embodiment further includes a third voltage controller 415.

As shown in FIG. 11, the third voltage controller 415 functions independently of the first voltage controller 409 and the second voltage controller 410, selects any of a plurality of predetermined layer-forming biases (DC voltage) as the second layer-forming voltage, either voltage Vbw to be applied to the layer-forming blade 102W in the image forming unit 10W (second image forming unit), which uses white toner, or voltage Vbcl to be applied to the layer-forming blade 102CL in the image forming unit 10CL, which uses clear toner, and applies the selected layer-forming bias to the mounted image forming unit (image forming unit 10W or 10CL, for example). In a case where the image forming unit 10W is mounted to the image forming apparatus 1*a*, for example, the third voltage controller 415 selects any one of a plurality of predetermined layer-forming biases (DC voltage) as the layer-forming bias Vbw to be applied to the layer-forming blade 102W and applies the selected layer-forming bias to the layer-forming blade 102W.

Examples of control biases applied to the elements in the image forming unit 10CL during image forming operation will next be described. When the image forming unit 10CL starts image forming operation, the developing-voltage controller 408 applies a developing bias (DC voltage) Vdcl of −200 V, for example, to the developing roller 101CL. The first voltage controller 409 applies a supply bias (DC voltage) Vscl of −300 V, for example, to the supply roller 103CL. The toner is supplied from the supply roller 103CL to the developing roller 101CL by applying the supply bias Vscl and developing bias Vdcl having the same polarity and by setting the supply bias Vscl and the developing bias Vdcl so that the absolute value |Vscl| of the supply bias is larger than the absolute value |Vdcl| of the developing bias.

The third voltage controller 415 applies a layer-forming bias (DC voltage) Vbcl of −150 V, for example, to the layer-forming blade 102CL which has the same polarity as the developing bias Vdcl. The charging-voltage controller 411 applies a charging bias of −1000 V, for example, to the charging roller 13CL, and the surface of the photosensitive drum 12CL is charged so that the surface potential of the photosensitive drum 12CL becomes −450 V, for example.

When the clear toner used in the image forming unit 10CL is carried by the developing roller 101CL and passes the layer-forming blade 102CL, the charge amount of the clear toner per unit weight becomes −30 μC/g, for example. Since the clear toner that has passed the layer-forming blade 102CL is negatively polarized, the clear toner carried by the developing roller 101CL adheres to the surface (an area exposed in accordance with image data, for example) of the photosensitive drum 12CL, resulting from the difference between the developing bias of the developing roller 101CL and the surface potential of the photosensitive drum 12CL. Control biases in the image forming unit 10CL are not limited to the example given above.

Control configurations of the elements in the image forming unit 10W (second image forming unit), which uses white toner, can adopt the same example of the control configurations as described in the first and second embodiments. Control configurations of the elements in the image forming units 10Y, 10C, 10M, and 10K (first image forming units), can adopt the same example of the control configurations as the image forming unit 10K described in the first and second embodiments. However, the control biases in the image forming units 10W, 10Y, 10C, 10M, and 10K are not limited to the examples described in the first and second embodiments.

In a case where the image forming apparatus 1*a* uses white toner, since the charge amount of white toner per unit weight is low (−7.4 μC/g, for example) (that is, the absolute value of the charge amount is small), stain is hard to occur on the recording medium, but fogging tends to occur on the recording medium. In a case where the image forming apparatus 1*a* uses clear toner, since the charge amount of clear toner per unit weight is high (−30 μC/g, for example) (that is, the absolute value of the charge amount is great), stain tends to occur on the recording medium, but fogging is hard to occur on the recording medium. According to the third embodiment, in a case where the image forming unit 10W and the image forming unit 10CL are exchanged, the third voltage controller 415, which is independent of the first voltage controller 409 and the second voltage controller 410, sets layer-forming biases (DC voltage) applied to the layer-forming blades 102W and 102CL separately, and layer-forming biases suited to the charging characteristics of the toner to be used can be specified easily, so that the image quality can be stabilized. In the present application, stain means that the toner (such as so-called excessively charged toner) having a higher charge amount (that is, the absolute value of the charge amount is greater) compared with a normally charged toner adheres to the background of the image (that is, a non-image area). The excessively charged toner that would cause this stain is referred to as stain toner.

The image forming unit 10W, which uses white toner, and the image forming unit 10CL, which uses clear toner, have been described as examples of image forming units that can be exchanged in the third embodiment, but types of toners of exchangeable image forming units are not limited to them. Image forming units which use other toners such as mica toner, ultraviolet (UV) toner, golden toner, and silver toner may be exchangeable in the image forming apparatus.

As described above, according to the third embodiment, since the third voltage controller 415, which is independent of the first voltage controller 409 and the second voltage controller 410, is used, layer-forming biases can be changed in accordance with the charging characteristics and other properties of the toner of the exchanged image forming unit, and high-quality images with little fogging or stain can be obtained in the simple configuration.

Although negative control voltages are applied to the elements in the image forming units 10W, 10Y, 10C, 10M, 10K, and 10CL in the embodiments described above, the present invention can be applied also when positive control voltages are applied to the elements in the image forming units (including an image forming unit using a metallic color toner). In other words, the present invention can be applied to the image forming units in which the control voltages applied to elements have the same polarity. In a case where the present invention is applied to such a configuration that positive control voltages are applied to elements in the image forming unit, it is preferable the image forming units use toners which are positively polarized.

First Variation

Figure 12:
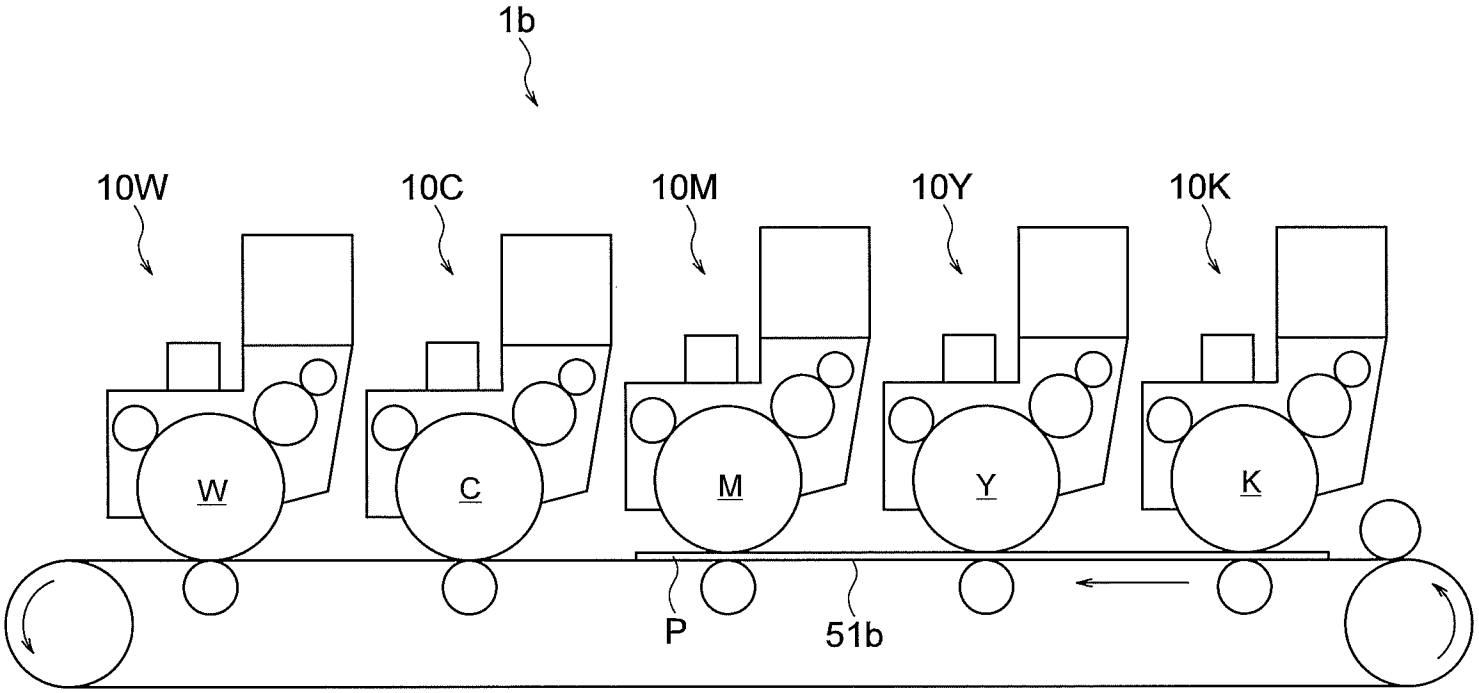
FIG. 12 is a longitudinal sectional view schematically showing an image forming apparatus as a first variation.

FIG. 12 is a longitudinal sectional view schematically showing a variation in which part of the internal structure of the image forming apparatuses 1 and 1*a* has been modified. In the embodiments described above, the image forming apparatuses 1 and 1*a* use the intermediate transfer method utilizing the intermediate transfer belt. The present invention, however, can be applied to image forming apparatuses using a direct transfer method, in which a toner image is transferred directly from the photosensitive drum to the recording medium P on the conveyor belt (transfer belt) 51*b*, as in the image forming apparatus 1*b* shown in FIG. 12.

In the embodiments described above, the image forming unit 10W, which uses white toner, is placed in the uppermost position in the moving direction of the intermediate transfer belt 51. However, the order in which the image forming units are arranged can be determined as desired, as shown in FIG. 12. For example, the image forming unit 10W may be placed in the lowermost position in the moving direction of the conveyor belt.

Second Variation

Figure 13:
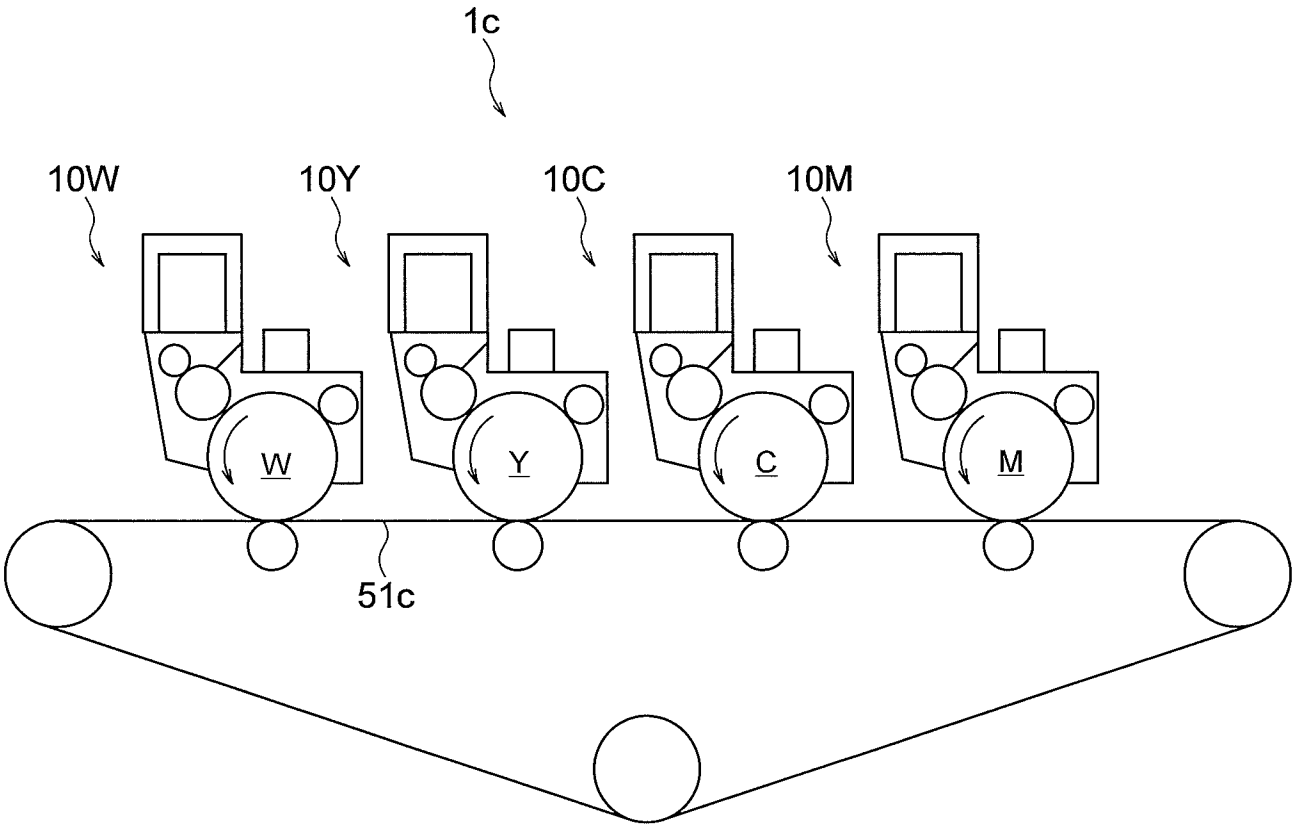
FIG. 13 is a longitudinal sectional view schematically showing an image forming apparatus as a second variation.

FIG. 13 is a longitudinal sectional view schematically showing a variation in which part of the internal structure of the image forming apparatuses 1 and 1*a* has been modified. In the respective embodiments described above, examples in which the five image forming units are arranged have been indicated, but the number of image forming units and the number of toner cartridges mounted in the image forming apparatus may be two to four or may also be six or more. The present invention can be applied to an image forming apparatus in which an image forming unit 10W, which uses white toner, and three image forming units, which use the toners of the other colors, are arranged on an intermediate transfer belt 51C, like the image forming apparatus 1*c* shown in FIG. 13, for example.

Further, in the embodiments and variations described above, tandem image forming apparatuses, in which a plurality of image carriers are arranged in parallel with one another, have been described. The present invention, however, can also be applied to a four-cycle color image forming apparatus having a single image carrier.

Further, in the embodiments and variations described above, DC voltage as the developing bias is applied to the first and second developer carrier, but superposed voltage obtained by superposing AC voltage on DC voltage as the developing bias may be applied to the first and second developer carrier. In this case, magnitude of the DC voltage component of the superposed voltage may be set appropriately as the developing bias regardless of frequency and peak-to-peak voltage of the AC voltage component.

Further, in the embodiments and variations described above, DC voltage as the layer-forming bias is applied to the first and second layer-forming member, but superposed voltage obtained by superposing AC voltage on DC voltage as the layer-forming bias may be applied to the first and second layer-forming member. In this case, magnitude of the DC voltage component of the superposed voltage may be set appropriately as the layer-forming bias regardless of frequency and peak-to-peak voltage of the AC voltage component.

What is claimed is:

1. An image forming apparatus comprising a plurality of image forming units;

the plurality of image forming units including:

a first image forming unit that uses a first developer having first charging characteristics; and a second image forming unit that uses a second developer having second charging characteristics differing from the first charging characteristics;

the first image forming unit including:

a first image carrier;

a first developer carrier that is applied with a first developing voltage and develops a latent image on the first image carrier with the first developer; and a first layer-forming member that is applied with a first layer-forming voltage having the same polarity as polarity of the first developing voltage and is disposed to face the first developer carrier;

the second image forming unit including:

a second image carrier;

a second developer carrier that is applied with a second developing voltage and develops a latent image on the second image carrier with the second developer; and a second layer-forming member that is applied with a second layer-forming voltage having the same polarity as polarity of the second developing voltage and is disposed to face the second developer carrier; wherein:

an absolute value of the first layer-forming voltage is smaller than an absolute value of the first developing voltage; and an absolute value of the second layer-forming voltage is greater than an absolute value of the second developing voltage.

2. The image forming apparatus of claim 1, wherein a difference between the absolute value of the second layer-forming voltage and the absolute value of the second developing voltage is greater than a difference between the absolute value of the first layer-forming voltage and the absolute value of the first developing voltage.

3. The image forming apparatus of claim 1, wherein the absolute value of the second developing voltage is smaller than the absolute value of the first developing voltage.

4. The image forming apparatus of claim 1, further comprising:

a first supply member that is disposed to face the first developer carrier, and is applied with a first supply voltage having the same polarity as the polarity of the first developing voltage to supply the first developer to the first developer carrier; and a second supply member that is disposed to face the second developer carrier, is applied with a second supply voltage having the same polarity as the polarity of the second developing voltage, and supplies the second developer to the second developer carrier; wherein $$|Vsb|-|Vdb|<|Vsw|-|Vdw|$$

is satisfied, where |Vsb| is an absolute value of the first supply voltage, |Vdb| is the absolute value of the first developing voltage, |Vsw| is an absolute value of the second supply voltage, and |Vdw| is the absolute value of the second developing voltage.

5. The image forming apparatus of claim 1, wherein $$0\ [V]<(|Vbw|-|Vdw|)\ [V]\leq 400\ [V]$$

is satisfied, where |Vbw| is the absolute value of the second layer-forming voltage, and |Vdw| is the absolute value of the second developing voltage.

6. The image forming apparatus of claim 1, wherein an absolute value of a charge amount of the second developer that has passed between the second layer-forming member and the second developer carrier is smaller than an absolute value of a charge amount of the first developer that has passed between the first layer-forming member and the first developer carrier.

7. The image forming apparatus of claim 1, wherein an absolute value |Q/M| of a charge amount Q/M [μC/g] of the second developer that has passed between the second layer-forming member and the second developer carrier satisfies:

$$5\ [\mu C/g]\leq|Q/M|\ [\mu C/g]\leq 10\ [\mu C/g].$$

8. The image forming apparatus of claim 1, wherein the second developer is negatively polarized.

9. The image forming apparatus of claim 1, wherein the second developer is positively polarized.

10. The image forming apparatus of claim 1, wherein the second developer includes a developer to which metal-containing colorant is added.

11. The image forming apparatus of claim 1, wherein the second developer is a white color developer.

12. The image forming apparatus of claim 1, wherein the second developer includes a developer containing a metal oxide, wherein any of a titanium oxide, an aluminum oxide, a barium sulfate, and a zinc oxide is contained as the metal oxide.

13. The image forming apparatus of claim 1, wherein the second developer is a metallic-color developer.

14. The image forming apparatus of claim 13, wherein the metallic-color developer contains any of aluminum, silver, and a fluorescent pigment.

15. The image forming apparatus of claim 1, wherein the absolute value of the second layer-forming voltage is greater than the absolute value of the first layer-forming voltage during image forming operation.

16. An image forming apparatus comprising:

a plurality of image forming units;

the plurality of image forming units including:

a first image forming unit that uses a first developer having first charging characteristics; and a second image forming unit including a second developer differing from the first developer in color;

the first image forming unit including:

a first image carrier;

a first developer carrier that is applied with a first developing voltage and develops a latent image on the first image carrier with the first developer; and a first layer-forming member that is applied with a first layer-forming voltage having the same polarity as polarity of the first developing voltage and is disposed to face the first developer carrier;

the second image forming unit including:

a second image carrier;

a second developer carrier that is applied with a second developing voltage and develops a latent image on the second image carrier with the second developer; and a second layer-forming member that is applied with a second layer-forming voltage having the same polarity as polarity of the second developing voltage and is disposed to face the second developer carrier;

wherein an absolute value of the first layer-forming voltage is smaller than an absolute value of the first developing voltage, and an absolute value of the second layer-forming voltage is greater than an absolute value of the second developing voltage.

17. The image forming apparatus of claim 16, wherein a difference between the absolute value of the second layer-forming voltage and the absolute value of the second developing voltage is greater than a difference between the absolute value of the first layer-forming voltage and the absolute value of the first developing voltage.

18. The image forming apparatus of claim 16, wherein the absolute value of the second developing voltage is smaller than the absolute value of the first developing voltage.

19. The image forming apparatus of claim 16, further comprising:

a first supply member that is disposed to face the first developer carrier, and is applied with a first supply voltage having the same polarity as the polarity of the first developing voltage to supply the first developer to the first developer carrier; and a second supply member that is disposed to face the second developer carrier, is applied with a second supply voltage having the same polarity as the polarity of the second developing voltage, and supplies the second developer to the second developer carrier; wherein $$|Vsb|-|Vdb|<|Vsw|-|Vdw|$$

is satisfied, where |Vsb| is an absolute value of the first supply voltage, |Vdb| is the absolute value of the first developing voltage, |Vsw| is an absolute value of the second supply voltage, and |Vdw| is the absolute value of the second developing voltage.

20. The image forming apparatus of claim 16, wherein $$0\ [V]<(|Vbw|-|Vdw|)\ [V]\leq 400\ [V]$$

is satisfied, where |Vbw| is the absolute value of the second layer-forming voltage, and |Vdw| is the absolute value of the second developing voltage.

21. The image forming apparatus of claim 16, wherein the second developer is a spot color developer.

22. The image forming apparatus of claim 21, wherein the spot color developer is a white color developer.

23. The image forming apparatus of claim 21, wherein the spot color developer is a metallic color developer.

24. The image forming apparatus of claim 16, wherein the second developer includes a developer to which metal-containing colorant is added.

25. The image forming apparatus of claim 16, wherein the second developer includes a developer containing a metal oxide.

26. The image forming apparatus of claim 25, wherein the metal oxide includes any of a titanium oxide, an aluminum oxide, a barium sulfate, and a zinc oxide.

27. The image forming apparatus of claim 24, wherein the metal-containing colorant contains any of aluminum, silver, and a fluorescent pigment.

28. The image forming apparatus of claim 16, wherein the absolute value of the second layer-forming voltage is greater than the absolute value of the first layer-forming voltage during image forming operation.

* * * * *